US006236302B1

(12) United States Patent
Barrett et al.

(10) Patent No.: US 6,236,302 B1
(45) Date of Patent: May 22, 2001

(54) MULTILAYER CONDUCTIVE POLYMER DEVICE AND METHOD OF MANUFACTURING SAME

(75) Inventors: Andrew Brian Barrett, Douglas; Denis Walsh, Ballinlough, both of (IE)

(73) Assignee: Bourns, Inc., Riverside, CA (US)

( * ) Notice: Subject to any disclaimer, the term of this patent is extended or adjusted under 35 U.S.C. 154(b) by 0 days.

(21) Appl. No.: 09/191,921

(22) Filed: Nov. 13, 1998

Related U.S. Application Data

(63) Continuation-in-part of application No. 09/035,196, filed on Mar. 5, 1998, now Pat. No. 6,172,591.

(51) Int. Cl.[7] ..... H01C 7/10; H01C 7/13

(52) U.S. Cl. ..... 338/22 R; 338/312; 338/295

(58) Field of Search ..... 338/22 R, 312, 338/313, 314, 295, 328, 332

(56) References Cited

U.S. PATENT DOCUMENTS

| | | | |
|---|---|---|---|
| H415 | 1/1988 | Newnham et al. | 338/22 R |
| 2,861,163 | 11/1958 | Asakawa | 201/72 |
| 2,978,665 | 4/1961 | Vernet et al. | 338/223 |
| 3,061,501 | 10/1962 | Dittman et al. | 156/250 |
| 3,138,686 | 6/1964 | Mitoff et al. | 200/142 |

(List continued on next page.)

FOREIGN PATENT DOCUMENTS

| | | | |
|---|---|---|---|
| 2838508 | 3/1980 | (DE) . | |
| 0158410 | 7/1984 | (EP) . | |
| 0853323 | 7/1998 | (EP) | H01C/1/14 |
| 1167551 | 10/1969 | (GB) . | |
| 62-240526 | 10/1987 | (JP) . | |
| 4-9069416 | 3/1997 | (JP) | H01C/7/02 |
| WO97/06660 | 2/1997 | (WO) . | |
| 98/12715 | 3/1998 | (WO) | H01C/9/02 |
| 98/29879 | 7/1998 | (WO) | H01C/7/02 |

OTHER PUBLICATIONS

Arrowsmith, D. J. (1970) "Adhesion of Electroformed Copper and Nickel to Plastic Laminates," *Transactions of the Institute of Metal Finishing*, vol. 48, pp. 88–92. (No. Month).

*Primary Examiner*—Michael L.. Gellner
*Assistant Examiner*—Kyung S. Lee
(74) *Attorney, Agent, or Firm*—Klein & Szekeres, LLP

(57) ABSTRACT

An electronic device includes two or more conductive polymer layers sandwiched between two external electrodes and one or more internal electrodes. A three layer device is manufactured by: (1) providing a first laminated substructure comprising a first polymer layer between first and second metal layers, a second polymer layer, and a second laminated substructure comprising a third polymer layer between third and fourth metal layers; (2) forming first and second arrays of isolation apertures in the second and third metal layers, respectively; (3) laminating the first and second substructures to opposite surfaces of the second polymer layer; (4) forming first and second arrays of external electrodes in the first and fourth metal layers, respectively; (5) forming a plurality of first terminals, each connecting an external electrode in the second external electrode array to an electrode-defining area in the second metal layer, and a plurality of second terminals, each connecting an external electrode in the first external electrode array to an electrode-defining area in the third metal array; and (6) singulating the laminated structure into separate devices, each including a first polymer layer between a first external electrode and a first internal electrode, a second polymer layer between first and second internal electrodes, and a third polymer layer between the second internal electrode and a second external electrode. Each device includes a first terminal connecting the first internal electrode to the second external electrode, and a second terminal connecting the second internal electrode to the first external electrode.

7 Claims, 13 Drawing Sheets

U.S. PATENT DOCUMENTS 3,187,164 6/1965 Andrich ..... 219/504
3,243,753 3/1966 Kohler ..... 338/31
3,535,494 10/1970 Armbruster ..... 219/528
3,619,560 11/1971 Buiting et al. ..... 219/300
3,689,736 9/1972 Meyer ..... 219/222
3,823,217 7/1974 Kampe ..... 264/105
3,824,328 7/1974 Ting et al. ..... 174/52 PE
3,878,501 4/1975 Moorhead et al. ..... 338/22 R
4,101,862 7/1978 Takagi et al. ..... 338/23
4,151,401 4/1979 Van Bokestal et al. ..... 219/508
4,177,376 12/1979 Horsma et al. ..... 219/553
4,177,446 12/1979 Diaz ..... 338/212
4,237,441 12/1980 van Konynenburg et al. .... 338/22 R
4,238,812 12/1980 Middleman et al. ..... 361/106
4,246,468 1/1981 Horsma ..... 219/553
4,250,398 2/1981 Ellis et al. ..... 219/345
4,272,471 6/1981 Walker ..... 264/104
4,314,230 2/1982 Cardinal et al. ..... 338/314
4,314,231 2/1982 Walty ..... 338/328
4,315,237 2/1982 Middleman et al. ..... 338/22 R
4,317,027 2/1982 Middleman et al. ..... 219/553
4,327,351 4/1982 Walker ..... 338/22 R
4,329,726 5/1982 Middleman et al. ..... 361/58
4,341,949 7/1982 Steiner et al. ..... 219/553
4,352,083 9/1982 Middleman et al. ..... 338/23
4,413,301 11/1983 Middleman et al. ..... 361/106
4,426,633 1/1984 Taylor ..... 338/25
4,445,026 4/1984 Walker ..... 219/553
4,481,498 11/1984 McTavish et al. ..... 338/20
4,542,365 9/1985 McTavish et al. ..... 338/20
4,545,926 10/1985 Foutz, Jr. et al. ..... 252/511
4,639,818 1/1987 Cherian ..... 361/106
4,647,894 3/1987 Ratell ..... 338/22 R
4,647,896 3/1987 Ratell ..... 338/22 R
4,654,511 3/1987 Horsma et al. ..... 219/548
4,685,025 8/1987 Carlomagno ..... 361/106
4,689,475 8/1987 Kleiner et al. ..... 219/553
4,698,614 10/1987 Welch et al. ..... 338/22 R
4,706,060 11/1987 May ..... 338/20
4,732,701 3/1988 Nishii et al. ..... 252/511
4,752,762 6/1988 Inano et al. ..... 338/22 R
4,766,409 8/1988 Mandai ..... 338/22 R
4,769,901 9/1988 Nagahori ..... 29/621
4,774,024 9/1988 Deep et al. ..... 252/511
4,787,135 11/1988 Nagahori ..... 29/612
4,800,253 1/1989 Kleiner et al. ..... 219/553
4,811,164 3/1989 Ling et al. ..... 361/321
4,849,133 7/1989 Yoshida et al. ..... 252/511
4,876,439 10/1989 Nagahori ..... 219/541
4,882,466 11/1989 Friel ..... 219/219
4,884,163 11/1989 Deep et al. ..... 361/58
4,904,850 2/1990 Claypool et al. ..... 219/548
4,907,340 3/1990 Fang et al. ..... 29/610.1
4,924,074 5/1990 Fang et al. ..... 219/548
4,937,551 6/1990 Plasko ..... 338/22 R
4,951,382 8/1990 Jacobs et al. ..... 29/611
4,951,384 8/1990 Jacobs et al. ..... 29/611
4,954,696 9/1990 Ishii et al. ..... 219/548
4,955,267 9/1990 Jacobs et al. ..... 29/611
4,967,176 10/1990 Horsma et al. ..... 338/22 R
4,980,541 12/1990 Shafe et al. ..... 219/548
4,983,944 1/1991 Uchida et al. ..... 338/22 R
5,015,824 5/1991 Monter et al. ..... 219/219
5,039,844 8/1991 Nagahori ..... 219/541
5,049,850 9/1991 Evans ..... 338/22 R
5,057,674 10/1991 Smith-Johannsen ..... 219/553
5,064,997 11/1991 Fang et al. ..... 219/505
5,089,688 2/1992 Fang et al. ..... 219/505
5,089,801 2/1992 Chan et al. ..... 338/22 R
5,140,297 8/1992 Jacobs et al. ..... 338/22 R
5,142,267 8/1992 Fellner et al. ..... 338/23
5,148,005 9/1992 Fang et al. ..... 219/505
5,164,133 11/1992 Ishida et al. ..... 264/105
5,166,658 11/1992 Fang et al. ..... 338/23
5,171,774 12/1992 Ueno et al. ..... 524/495
5,174,924 12/1992 Yamada et al. ..... 252/511
5,178,797 1/1993 Evans ..... 252/508
5,181,006 1/1993 Shafe et al. ..... 338/22 R
5,190,697 3/1993 Okita et al. ..... 252/511
5,195,013 3/1993 Jacobs et al. ..... 361/106
5,210,517 5/1993 Abe ..... 338/22
5,212,466 5/1993 Yamada et al. ..... 338/22 R
5,227,946 7/1993 Jacobs et al. ..... 361/106
5,241,741 9/1993 Sugaya ..... 29/612
5,247,277 9/1993 Fang et al. ..... 338/22 R
5,250,228 10/1993 Baigrie et al. ..... 252/511
5,280,263 1/1994 Sugaya ..... 338/22 R
5,303,115 4/1994 Nayar et al. ..... 361/106
5,351,390 10/1994 Yamada et al. ..... 29/612
5,358,793 10/1994 Hanada et al. ..... 428/560
5,699,607 12/1997 McGuire et al. ..... 29/612
5,802,709 9/1998 Hogge et al. ..... 29/827
5,812,048 9/1998 Ross, Jr. et al. ..... 338/128
5,831,510 11/1998 Zhang et al. ..... 338/22 R
5,852,397 12/1998 Chan et al. ..... 338/22 R
5,864,281 1/1999 Zhang et al. ..... 338/22 R
6,020,808 * 2/2000 Hogge ..... 338/22 R
6,157,289 * 12/2000 Kojima et al. ..... 338/22 R

* cited by examiner

MULTILAYER CONDUCTIVE POLYMER DEVICE AND METHOD OF MANUFACTURING SAME

CROSS-REFERENCE TO RELATED APPLICATIONS

This application is a Continuation-in-Part of application Ser. No. 09/035,196; filed Mar. 5, 1998, now a U.S. Pat. No. 6,172,591.

FEDERALLY SPONSORED RESEARCH OR DEVELOPMENT

Not Applicable

BACKGROUND OF THE INVENTION

The present invention relates generally to the field of conductive polymer positive temperature coefficient (PTC) devices. More specifically, it relates to conductive polymer PTC devices that are of laminar construction, with more than a single layer of conductive polymer PTC material, and that are especially configured for surface-mount installations.

Electronic devices that include an element made from a conductive polymer have become increasingly popular, being used in a variety of applications. They have achieved widespread usage, for example, in overcurrent protection and self-regulating heater applications, in which a polymeric material having a positive temperature coefficient of resistance is employed. Examples of positive temperature coefficient (PTC) polymeric materials, and of devices incorporating such materials, are disclosed in the following U.S. patents:

U.S Pat. No. 3,823,217—Kampe
U.S Pat. No. 4,237,441—van Konynenburg
U.S Pat. No. 4,238,812—Middleman et al.
U.S Pat. No. 4,317,027—Middleman et al.
U.S Pat. No. 4,329,726—Middleman et al.
U.S Pat. No. 4,413,301—Middleman et al.
U.S Pat. No. 4,426,633—Taylor
U.S Pat. No. 4,445,026—Walker
U.S Pat. No. 4,481,498—McTavish et al.
U.S Pat. No. 4,545,926—Fouts, Jr. et al.
U.S Pat. No. 4,639,818—Cherian
U.S Pat. No. 4,647,894—Ratell
U.S Pat. No. 4,647,896—Ratell
U.S Pat. No. 4,685,025—Carlomagno
U.S Pat. No. 4,774,024—Deep et al.
U.S Pat. No. 4,689,475—Keiner et al.
U.S Pat. No. 4,732,701—Nishii et al.
U.S Pat. No. 4,769,901—Nagahori
U.S Pat. No. 4,787,135—Nagahori
U.S Pat. No. 4,800,253—Kleiner et al.
U.S Pat. No. 4,849,133—Yoshida et al.
U.S Pat. No. 4,876,439—Nagahori
U.S Pat. No. 4,884,163—Deep et al.
U.S Pat. No. 4,907,340—Fang et al.
U.S Pat. No. 4,951,382—Jacobs et al.
U.S Pat. No. 4,951,384—Jacobs et al.
U.S Pat. No. 4,955,267—Jacobs et al.
U.S Pat. No. 4,980,541—Shafe et al.
U.S Pat. No. 5,049,850—Evans
U.S Pat. No. 5,140,297—Jacobs et al.
U.S Pat. No. 5,171,774—Ueno et al.

U.S Pat. No. 5,174,924—Yamada et al.
U.S Pat. No. 5,178,797—Evans
U.S Pat. No. 5,181,006—Shafe et al.
U.S Pat. No. 5,190,697—Ohkita et al.
U.S Pat. No. 5,195,013—Jacobs et al.
U.S Pat. No. 5,227,946—Jacobs et al.
U.S Pat. No. 5,241,741—Sugaya
U.S Pat. No. 5,250,228—Baigrie et al.
U.S Pat. No. 5,280,263—Sugaya
U.S Pat. No. 5,358,793—Hanada et al.

One common type of construction for conductive polymer PTC devices is that which may be described as a laminated structure. Laminated conductive polymer PTC devices typically comprise a single layer of conductive polymer material sandwiched between a pair of metallic electrodes, the latter preferably being a highly-conductive, thin metal foil. See, for example, U.S. Pat. No. 4,426,633—Taylor; U.S Pat. No. 5,089,801—Chan et al.; U.S Pat. No. 4,937,551—Plasko; and U.S Pat. No. 4,787,135—Nagahori; and International Publication No. WO97/06660.

A relatively recent development in this technology is the multilayer laminated device, in which two or more layers of conductive polymer material are separated by alternating metallic electrode layers (typically metal foil), with the outermost layers likewise being metal electrodes. The result is a device comprising two or more parallel-connected conductive polymer PTC devices in a single package. The advantages of this multilayer construction are reduced surface area ("footprint") taken by the device on a circuit board, and a higher current-carrying capacity, as compared with single layer devices.

In meeting a demand for higher component density on circuit boards, the trend in the industry has been toward increasing use of surface mount components as a space-saving measure. Surface mount conductive polymer PTC devices heretofore available have been generally limited to hold currents below about 2.5 amps for packages with a board footprint that generally measures about 9.5 mm by about 6.7 mm. Recently, devices with a footprint of about 4.7 mm by about 3.4 mm, with a hold current of about 1.1 amps, have become available. Still, this footprint is considered relatively large by current surface mount technology (SMT) standards.

The major limiting factors in the design of very small SMT conductive polymer PTC devices are the limited surface area and the lower limits on the resistivity that can be achieved by loading the polymer material with a conductive filler (typically carbon black). The fabrication of useful devices with a volume resistivity of less than about 0.2 ohm-cm has not been practical. First, there are difficulties inherent in the fabrication process when dealing with such low volume resistivities. Second, devices with such a low volume resistivity do not exhibit a large PTC effect, and thus are not very useful as circuit protection devices.

The steady state heat transfer equation for a conductive polymer PTC device may be given as:

$$0=[I^2R(f(T_d))]-[U(T_d-T_a)], \quad (1)$$

where I is the steady state current passing through the device; $R(f(T_d))$ is the resistance of the device, as a function of its temperature and its characteristic "resistance/temperature function" or "R/T curve"; U is the effective heat transfer coefficient of the device; $T_d$ is temperature of the device; and $T_a$ is the ambient temperature.

The "hold current" for such a device may be defined as the maximum value of I guaranteed not to trip the device from a low resistance state to a high resistance state. For a given device, where U is fixed, the only way to increase the hold current is to reduce the value of R. A hold current of 1.1 A should be achievable for a single layer device, 1.8A for a two layer device and 2.6A for a three-layer polymer PTC device each having a footprint of 4.5 mm by 3.2 mm.

The governing equation for the resistance of any resistive device can be stated as:

$$R=\rho L/A, \quad (2)$$

where ρ is the volume resistivity of the resistive material in ohm-cm, L is the current flow path length through the device in cm, and A is the effective cross-sectional area of the current path in $cm^2$. Thus, the value of R can be reduced either by reducing the volume resistivity ρ, or by increasing the cross-sectional area A of the device. The value of the volume resistivity ρ can be decreased by increasing the proportion of the conductive filler loaded into the polymer. The practical limitations of doing this, however, are noted above.

A more practical approach to reducing the resistance value R is to increase the cross-sectional area A of the device. Besides being relatively easy to implement (from both a process standpoint and from the standpoint of producing a device with useful PTC characteristics), this method has an additional benefit: In general, as the area of the device increases, the value of the heat transfer coefficient also increases, thereby further increasing the value of the hold current.

In SMT applications, however, it is necessary to minimize the effective surface area or footprint of the device. This puts a severe constraint on the effective cross-sectional area of the PTC element in device. Thus, for a device of any given footprint, there is an inherent limitation in the maximum hold current value that can be achieved. Viewed another way, decreasing the footprint can be practically achieved only by reducing the hold current value.

There has thus been a long-felt, but as yet unmet, need for very small footprint SMT conductive polymer PTC devices that achieve relatively high hold currents.

SUMMARY OF THE INVENTION

Broadly, the present invention is a conductive polymer PTC device that has a relatively high hold current while maintaining a very small circuit board footprint. This result is achieved by a multilayer construction that provides an increased effective cross-sectional area A of the current flow path for a given circuit board footprint. In effect, the multilayer construction of the invention provides, in a single, small-footprint surface mount package, two or more PTC devices electrically connected in parallel.

In one aspect, the present invention is a conductive polymer PTC device comprising, in a preferred embodiment, multiple alternating layers of metal foil and PTC conductive polymer material, with electrically conductive interconnections to form two or more conductive polymer PTC devices connected to each other in parallel, and with termination elements configured for surface mount termination.

Specifically, two of the metal layers form, respectively, first and second external electrodes. The remaining metal layers form a plurality of internal electrodes that physically separate and electrically connect two or more conductive polymer layers located between the external electrodes. The electrodes are staggered to create two sets of alternating electrodes: a first set that is in electrical contact with the first terminal, and a second set that is in electrical contact with the second terminal. One of the terminals serves as an input terminal, and the other serves as an output terminal.

A first embodiment of the invention comprises a three layer conductive polymer device having first, second, and third conductive polymer layers. In a preferred embodiment, the conductive polymer exhibits PTC characteristics. A first external electrode is in electrical contact with a first terminal and with an exterior surface of the first conductive polymer layer that is opposed to the surface facing the second conductive polymer layer. A second external electrode is in electrical contact with a second terminal and with an exterior surface of the third conductive polymer layer that is opposed to the surface facing the second conductive polymer layer. The first and second conductive polymer layers are separated by a first internal electrode that is in electrical contact with the second terminal, while the second and third conductive polymer layers are separated by a second internal electrode that is in electrical contact with the first terminal.

In such an embodiment, if the first terminal is an input terminal and the second terminal is an output terminal, the current flow path is from the first terminal to the first external electrode and to the second internal electrode. From the first external electrode, current flows through the first conductive polymer layer to the first internal electrode and then to the second terminal. From the second internal electrode, current flows through the second conductive polymer layer to the first internal electrode and then to the second terminal, and through the third conductive polymer layer to the second external electrode and then to the second terminal.

Thus, the resulting device is a three layer device in which three layers of conductive polymer (preferably PTC) are connected in parallel. This construction provides the advantages of a significantly increased effective cross-sectional area for the current flow path, as compared with a single layer device, without increasing the footprint. Thus, for a given footprint, a larger hold current can be achieved. Alternatively, devices with only two conductive polymer layers, or with four or more such layers, can be fabricated, with similar benefits and advantages.

Another aspect of the present invention is a method of fabricating the above-described devices. For a device having three conductive polymer layers, this method comprises the steps of: (1) providing (a) a first laminated substructure comprising a first conductive polymer layer sandwiched between first and second metal layers, (b) a second conductive polymer layer, and (c) a second laminated substructure comprising a third conductive polymer layer sandwiched between third and fourth metal layers; (2) forming first and second arrays of isolation apertures in corresponding areas of the second and third metal layers; (3) laminating the first and second laminated substructures to opposite surfaces of the second conductive polymer layer to form a laminated structure comprising the first conductive polymer layer sandwiched between the first and second metal layers, the second conductive polymer layer sandwiched between the second and third metal layers, and the third conductive polymer layer sandwiched between the third and fourth metal layers, the isolation apertures being filled with polymer as a result of the lamination; (4) isolating selected areas in the first and fourth metal layers to form first and second arrays of external electrodes in the first and fourth metal layers, respectively, the external electrodes in each array being separated from each other by isolated contact areas; (5) forming a plurality of first terminals and a plurality of second terminals, each of the first terminals electrically connecting one of the electrodes in the second external electrode array to a defined area in the second metal layer through a via in a polymer-filled isolation aperture in the third metal layer, and each of the second terminals electrically connecting one of the electrodes in the first external electrode array to a defined area in the third metal layer through a via in a polymer-filled isolation aperture in the second metal layer; and (6) separating the laminated structure into a plurality of devices, each comprising two external electrodes and two internal electrodes, a first terminal electrically connecting one external electrode to one internal electrode, and a second terminal electrically connecting the other external electrode to the other internal electrode.

The step of forming the first and second terminals comprises the steps of (a) forming vias at spaced intervals in the laminated structure, each of the vias intersecting an external electrode in each of the first and second external arrays and one of either the second or third (internal) metal layers, and passing through one of either the first or second arrays of isolation apertures; (b) plating the peripheral surfaces of the vias and adjacent surface portions of the isolated metal areas in the first and second external arrays with a conductive metal plating; and (c) overlaying a solder plating over the metal-plated surfaces.

The separation step of the fabrication process comprises the step of singulating the laminated structure into a plurality of individual conductive polymer devices, each of which has the structure described above.

In a second embodiment, a two layer device comprises a first and a second terminal, and first and second conductive polymer layers. Each conductive polymer layer has first and second opposed surfaces. The first and second conductive polymer layers are separated by a single internal electrode that is in electrical contact with the first terminal, with the second surface of the first conductive polymer layer and with the first surface of the second conductive polymer layer. The first external electrode is in electrical contact with the second terminal and with the first surface of the first conductive polymer layer. A second external electrode is in electrical contact with the second terminal and with the second surface of the second conductive polymer layer.

In a more particular embodiment of the two layer device, the second terminal is connected to the second external electrode through a via in a polymer-filled isolation aperture in the internal electrode, and the first terminal is in electrical contact with the internal electrode, while being isolated from the first and second external electrodes.

The two layer electronic device is formed by providing a first laminated substructure comprising a first conductive polymer layer sandwiched between a first and second metal layers, and a second laminated substructure comprising a second layer of conductive polymer material laminated to a third metal layer. An array of isolation apertures is formed in the first metal layer. The first and second laminated substructures are then laminated so as to create a laminated structure, the isolation apertures becoming filled with polymer during the lamination. The laminated structure has a first conductive polymer layer sandwiched between the first and second metal layers, and a second conductive polymer layer sandwiched between the first and third metal layers. A first array of external electrodes is then formed in the third metal layer, and a second array of external electrodes is formed in the second metal layer. The external electrodes in the second and third metal layers are vertically aligned and registered with each other. The polymer-filled isolation apertures in the first metal layer are horizontally staggered between the external electrodes in the second and third metal layers. The laminated structure is then drilled to form vias (at least some of which pass through the polymer-filled isolation apertures), the vias are plated through to form a plurality of first and second terminals, and the structure is parceled into a plurality of two layer electronic devices, each having a single first terminal and a single second terminal.

During the process of formation, a plurality of first terminals is formed, each of which is in electrical contact with the first metal layer. Also, a plurality of second terminals is formed, each of which electrically connects the second and third metal layers to each other through a via in a polymer-filled isolation aperture in the first metal layer. After parceling, each electronic device produced has first and second polymer layers that operate in parallel between the first and second terminal.

In yet another embodiment, a four layer device comprises first, second, third, and fourth conductive polymer layers. The first and fourth conductive polymer layers are separated by a first internal electrode that is in electrical contact with a first terminal. The first and second conductive polymer layers are separated by a second internal electrode that is in electrical contact with a second terminal. The second and third conductive polymer layers are separated by a third internal electrode that is in electrical contact with the first terminal.

A first external electrode is in electrical contact with the second terminal and with an exterior surface of the third conductive polymer layer that is opposed to the surface facing the second conductive polymer layer. A second external electrode is in contact with an exterior surface of the fourth conductive polymer layer that is opposed to the surface facing the first conductive polymer layer.

The device has a first terminal that electrically connects the first and third internal electrodes through a via in an isolation aperture in the second internal electrode. The device has a second terminal that electrically connects the first external electrode to the second internal electrode through a via in a polymer-filled isolation aperture in the third internal electrode, and to the second external electrode through a via in a polymer-filled isolation aperture in the first internal electrode.

The method for making a four layer device having four conductive polymer layers, is similar to that for a three layer device except that a third laminated substructure, comprising a fifth metal layer laminated to a fourth conductive polymer layer, is additionally provided in the first step. The method then proceeds as follows (from the second step):

(2) Forming first, second, and third arrays of isolation apertures in corresponding areas of the first, second, and third metal layers, respectively;

(3) Laminating the first and second laminated substructures to opposite surfaces of the second conductive polymer layer and laminating the fourth conductive polymer layer to the first metal layer to form a laminated structure comprising the first conductive polymer layer sandwiched between the first and second metal layers, the second conductive polymer layer sandwiched between the second and third metal areas, the third conductive polymer layer sandwiched between the third layer and the fourth metal layer, and the fourth conductive polymer layer sandwiched between the first and fifth metal layers (the fourth and fifth metal layers being external metal layers);

(4) Isolating selected areas of the fourth and fifth metal layers to form first and second arrays of isolated external electrodes in the fourth and fifth (external) metal layers, the electrodes in each of the first and second electrode arrays being separated from each other by an array of isolated contact areas;

(5) Forming a plurality of first terminals, each electrically connecting a defined area in the first metal layer to a defined area in the third metal layer, and forming a plurality of second terminals, each electrically connecting a defined area in the second metal layer to one of the external electrodes in the first external electrode array and to one of the external electrodes in the second external electrode array; and (6) separating the laminated structure into a plurality of individual devices, each comprising two external electrodes and three internal electrodes, a single first terminal in electrical contact with two external electrodes and one internal electrode, and a single second terminal in electrical contact with the other two internal electrodes.

The above-mentioned advantages of the present invention, as well as others, will be more readily appreciated from the detailed description that follows.

DETAILED DESCRIPTION OF THE INVENTION

Figure 1:
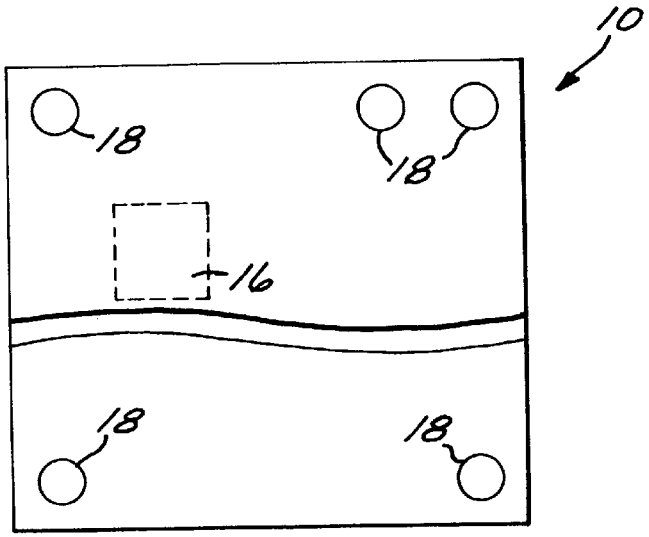
FIG. 1 is a top plan view of a laminated structure fabricated in accordance with the present invention.
Figure 2:
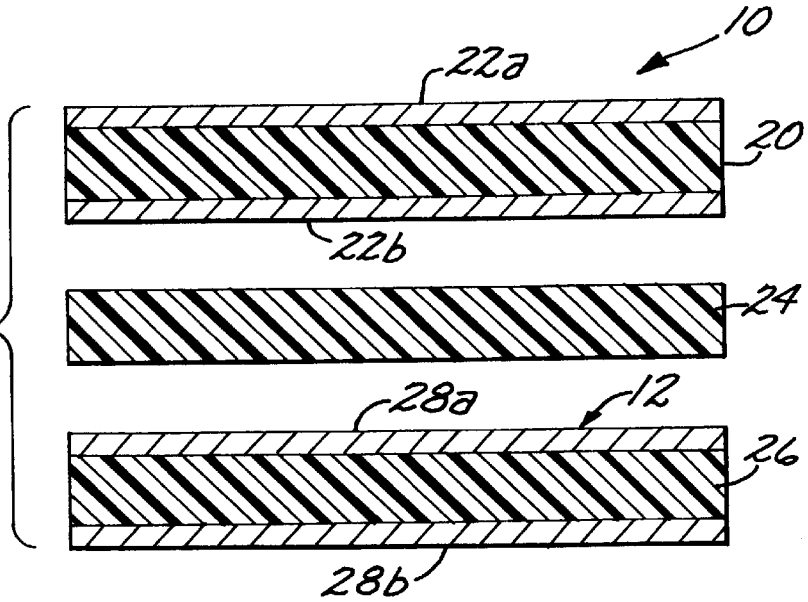
FIG. 2 is an idealized cross-sectional view of the top and bottom laminated substructures and a middle conductive polymer layer, illustrating the first step in making a conductive polymer device in accordance with the method of the present invention.

Referring now to the drawings, FIG. 1 is a plan view of a first laminated substructure 10 stacked above an unseen second laminated substructure 12 (shown in FIG. 2). A conductive polymer layer of conductive polymer material (also unseen) is interposed between the first laminated substructure 10 and the second laminated substructure 12. The first laminated substructure 10, the second laminated substructure 12 and the layer, of conductive polymer material are shown in FIG. 2 in an exploded sectional view taken across an arbitrary region 16 of FIG. 1 bordered by dashed lines. Registration holes 18 penetrate the first laminated substructure 10, the second laminated substructure 12 and the layer of conductive polymer material and provide for positive alignment of the respective layers when alignment pins (not shown) are inserted therein.

FIG. 2 shows the first laminated substructure 10, and the second laminated substructure 12. Providing the first and second laminated substructures 10, 12 is an initial step in the process of fabricating a conductive polymer device in accordance with the present invention. The first laminated substructure 10 comprises a first conductive polymer layer 20 of conductive polymer material sandwiched between first and second metal layers 22*a*, 22*b*. A second conductive polymer layer 24 (or middle layer) of conductive polymer material is provided for lamination between the first substructure 10 and the second substructure 12 in a subsequent step in the process, as will be described below. The second substructure 12 comprises a third conductive polymer layer 26 of conductive polymer PTC material sandwiched between third and fourth metal layers 28*a*, 28*b*.

The first, second and third layers 20, 24, 26 may be made of any suitable conductive polymer composition, such as, for example, high density polyethylene (HDPE) or polyvinylidene difluoride (PVDF), into which is mixed an amount of a conductive filler (preferably carbon black) that results in the desired electrical operating characteristics. Preferably, the conductive polymer material is formulated so as to exhibit PTC characteristics in accordance with a desired set of operational criteria and specifications. Other materials, such as antioxidants and/or cross-linking agents, may also be mixed into the composition. The particular types of the constituent materials, and their proportions, depend upon the specific electrical and mechanical characteristics and specifications desired. See, for example, U.S. Pat. No. 4,237,441—van Konynenburg et al. and U.S Pat. No. 5,174,924—Yamada et al.

The laminated substructures 10, 12 may be fabricated by a number of methods well-known in the art. See, for example, U.S. Pat. No. 4,426,633—Taylor; U.S Pat. No. 5,089,801—Chan et al.; U.S Pat. No. 4,937,551—Plasko; and U.S Pat. No. 4,787,135—Nagahori. A preferred method is disclosed in U.S. Pat. No. 5,802,709—Hogge et al., assigned to the assignee of the present invention, the disclosure of which is incorporated herein by reference.

The metal layers 22*a*, 22*b*, 28*a*, and 28*b* may be made of copper or nickel foil, with nickel being preferred for the second and third (internal) metal layers 22*b*, 28*a*. If the metal layers 22*a*, 22*b*, 28*a*, and 28*b* are made of copper foil, those foil surfaces that contact the conductive polymer layers are coated with a nickel flash coating (not shown) to prevent unwanted chemical reactions between the polymer and the copper. These polymer contacting surfaces are also preferably "modularized", by well-known techniques, to provide a roughened surface that provides good adhesion between the metal and the polymer. Thus, the second and third (internal) metal layers 22*b*, 28*a* are both nodularized surfaces, while the first and fourth (external) metal layers 22*a*, 28*b* are nodularized only on the single surface that contacts an adjacent conductive polymer layer.

Registration holes represent one means for maintaining the substructures 10, 12 and the second layer 24 of conductive polymer in the proper relative orientation or registration for carrying out the subsequent steps in the fabrication process. Preferably, this is done by forming (e.g., by punching or drilling) a plurality of registration holes 18 in the corners of the substructures 10, 12 and the middle polymer layer 24, as shown in FIG. 1. Other registration techniques, well known in the art, may also be used.

Figure 3A:
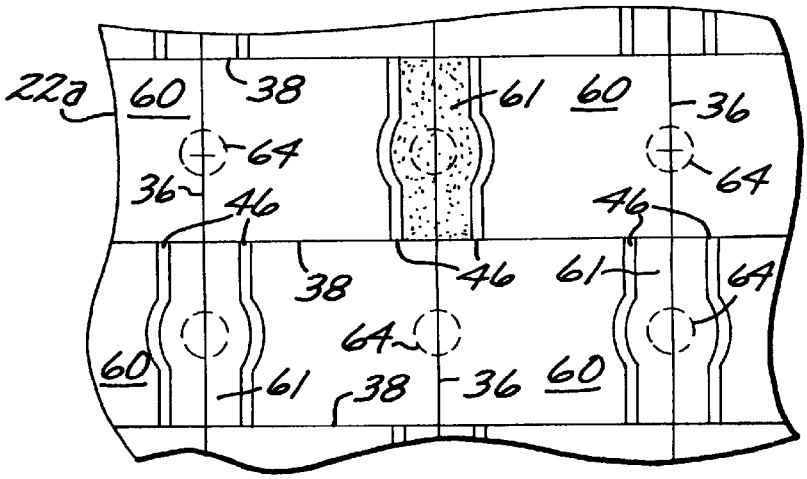
FIGS. 3*a*–3*d* are idealized plan views of a portion of the first, second, third and fourth metal layers of the laminated structure of FIG. 1, showing their respective etch patterns.
Figure 3B:
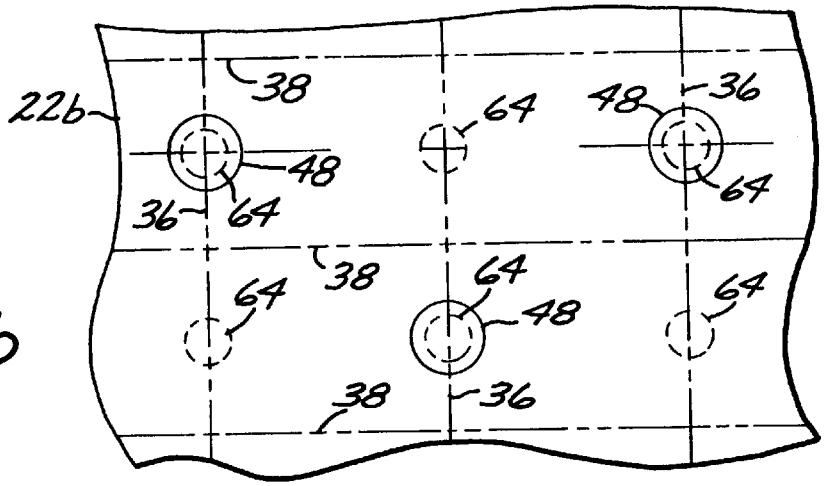
Figure 3C:
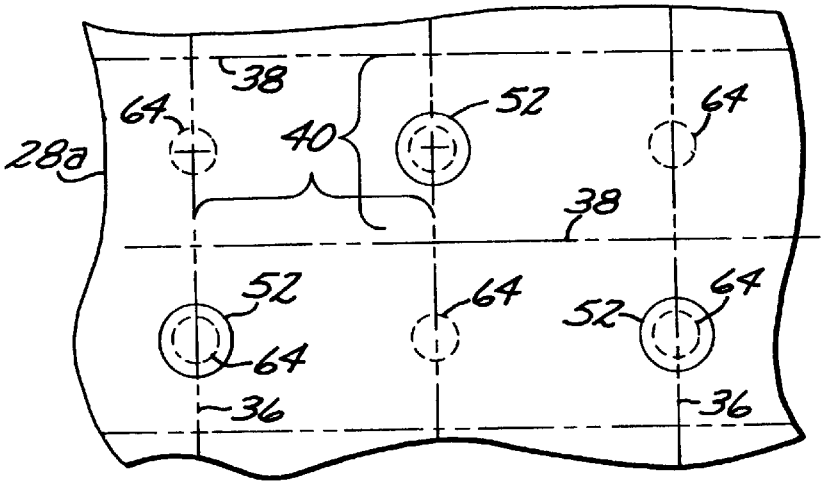
Figure 3D:
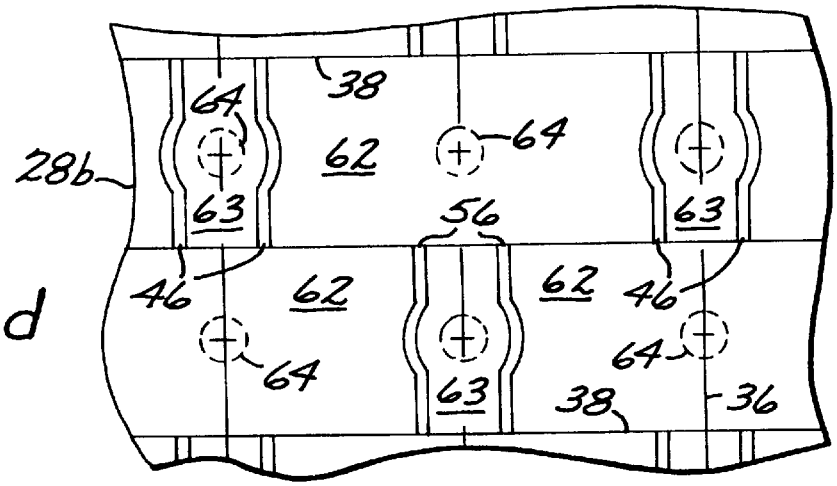

FIGS. 3*a*–3*d* depict patterns that are etched through the first, second, third and fourth metal layers 22*a*, 22*b*, 28*a*, and 28*b* respectively, in the course of the following process steps. A first set of grid lines 36 and a second set grid lines 38, formed perpendicularly with the first set 36, are etched into both the first and fourth metal layers, as shown in FIGS. 3*a* and 3*d*. The grid lines 36, 38 form an orthogonal grid that is shown in FIGS. 3*a*–3*d* to illustrate how the patterns of features shown in these figures are registered with respect to each other. The grid lines 36, 38 are etched in the external (first and fourth) metal layers 22*a*, 28*b* only, so as to form score lines that are used for singulating the laminated structure that is formed from the components shown in FIG. 2 into individual conductive polymer PTC devices, as described below. The grid lines 36, 38 delineate arrays of rectangular metal areas or "parcels" on each of the respective metal layers at corresponding locations with respect to the registration holes 18, that identify the limits of individual devices to be later formed. In FIG. 3*c*, brackets 40 show the dimensions to be assumed by an individual device (after singulation, as described below), as defined by the grid lines 36, 38 and the area contained therebetween. While the grid lines 36, 38 appear only on the first and fourth metal layers 22*a*, 28*b* (FIGS. 3*a* and 3*d*), they are shown in phantom outline in FIGS. 3*b* and 3*c* to assist in understanding the relative locations of the other structures shown in these drawings.

FIG. 3*a* shows a first array of external isolation channels 46 formed in the first metal layer 22*a*. FIG. 3*b* shows a first internal array of isolation apertures 48 formed in the second metal layer 22*b*. FIG. 3*c* shows a second internal array of isolation apertures 52 formed in the third metal layer 28*a*. FIG. 3*d* shows a second array of external isolation channels 46 formed in the fourth metal layer 28*b*.

Subsequent to scoring the resulting laminated structure along the score lines defined by the grid lines 36, 38, as described below, the first array of external isolation channels 46 forms a first external array of isolated metal areas 60 in the first metal layer 22*a*, separated by metal islands 61 (FIG. 3*a*), and a second external array of isolated metal areas 62, separated by metal islands 63, in the fourth metal layer 28*b* (FIG. 3*d*). The first set of score lines 36 bisects each of the first external array isolated metal areas 60 (in the first metal layer 22*a*) and each of the second external array of isolated metal areas 62 (in the fourth metal layer 28*b*). FIGS. 3*a*, 3*b* 3*c*, and 3*d* depict a pattern of drill holes or vias 64 to be applied to the resulting laminated structure. The via centers are shown as addressed or registered on the centers of first and second internal arrays of isolation apertures 48, 52, respectively. The location of the via centers is common to the centers of the first and second internal arrays of isolation apertures 48, 52 in the second and third metal layers, respectively, and it is also common to the centers of the first and second arrays of metal islands 61, 63 in the first and fourth metal layers, respectively. The via locations on the first and fourth metal layers 22*a*, 28*b* are indicated by dashed circles mapped onto the metal island areas 61, 63 of FIGS. 3*a* and 3*d*, respectively. In the preferred embodiment, all of the vias 64 are drill holes. The diameter of the vias 64 is sufficiently smaller than the etched diameter of the isolation apertures 48, 52 so as to ensure isolation when the vias 64 are later metallized, as described below.

Figure 4:
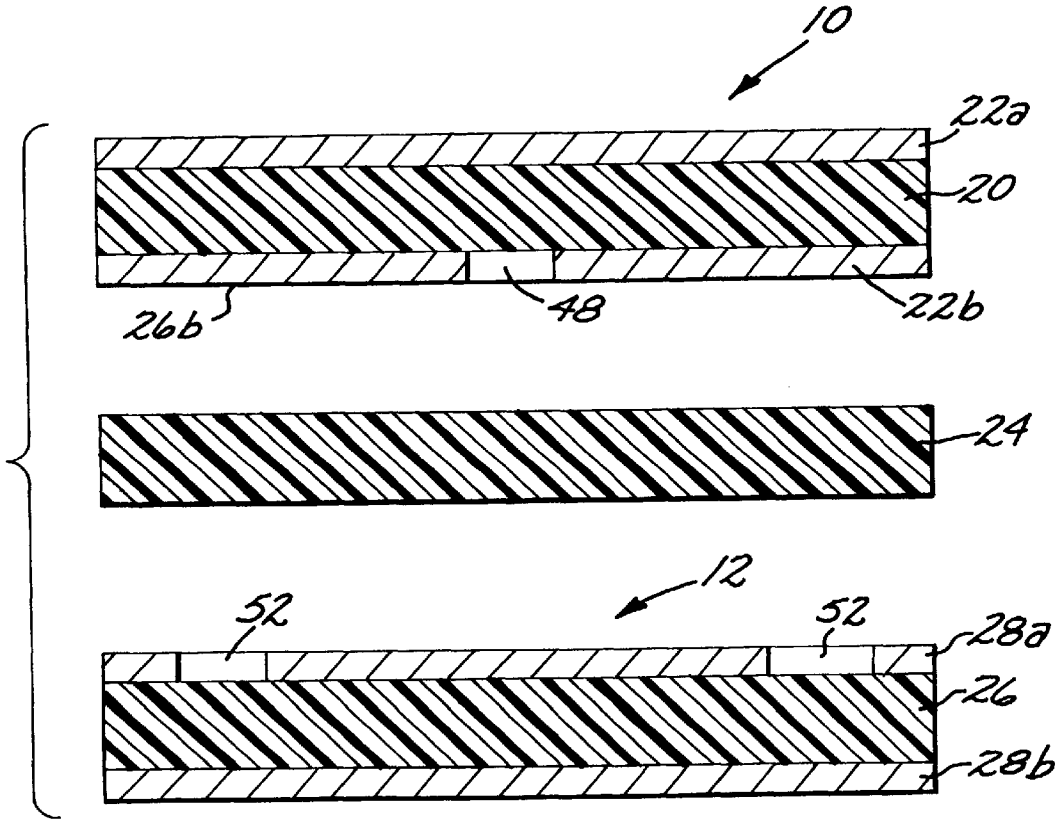
FIG. 4 is an idealized cross-sectional view, similar to that of FIG. 2, after the performance of the step of creating first and second internal arrays of isolation apertures in the second and third metal layers of the laminated substructures of FIG. 2.
Figure 5:
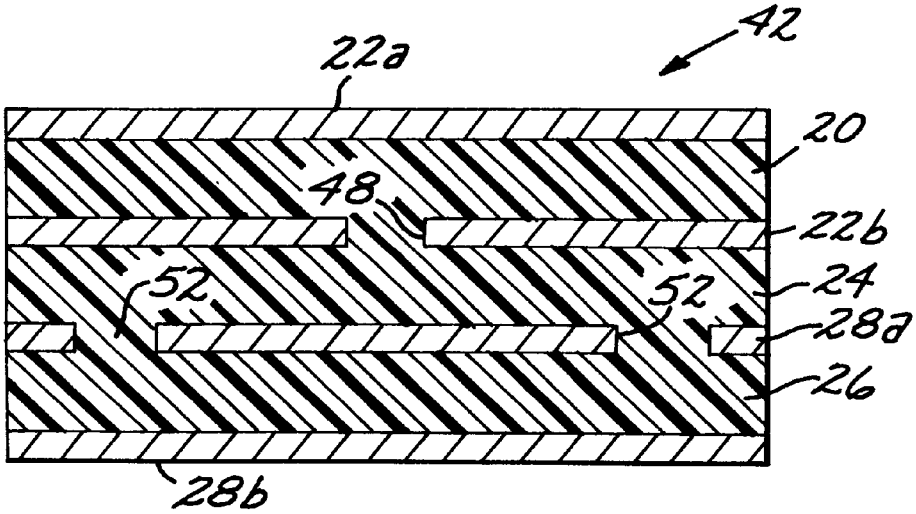
FIG. 5 is an idealized cross-sectional view showing the composite laminated structure formed after the lamination of the first and second substructures and the middle conductive polymer layer of FIG. 2.
Figure 6:
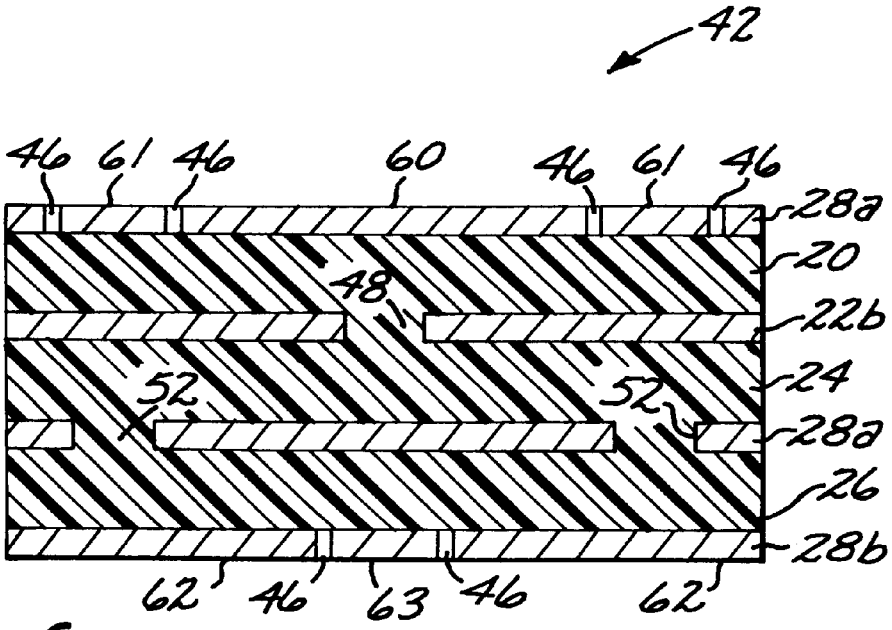
FIG. 6 is a cross-sectional view of the laminated structure of FIG. 5, after the performance of the step of creating first and second external arrays of isolation channel pairs respectively in the first and fourth metal layers shown in FIG. 2.

FIGS. 4–6 depict, in cross-sectional views similar to that of FIG. 2, the successive steps of forming the etched features described above and illustrated in FIGS. 3*a*–3*d*. First, as shown in FIG. 4, a first array of internal isolation apertures 48 (only one of which is shown in FIG. 4), registered in accordance with the grid patterns of FIG. 3*b*, is formed in the second metal layer 22*b*. A second array of internal isolation apertures 52, registered in accordance with the grid patterns of FIG. 3*c*, is formed in the third metal layer 28*a*. As shown in FIGS. 3*b*, 3*c*, and 4, the first and second internal arrays of isolation apertures 48, 52 are registered in alternating parcels or metal areas defined by the grid lines 36, 38. Specifically, the internal isolation apertures 48 in the first array are positioned on an alternating grid with index locations that are between the positions of the internal isolation apertures 52 in the second array.

The removal of metal from the second and third metal layers 22*b*, 28*a* to form the first and second arrays of internal isolation apertures 48, 52 is accomplished by conventional printed circuit board fabrication methods such as those techniques employing photoresist, masks and etching methods.

FIG. 5 shows a laminated structure 42 that is the result of laminating the substructures 10, 12 and the middle conductive polymer layer 24 after ensuring that the layers are in proper registration. The middle conductive polymer layer 24 is laminated between the substructures 10, 12 by a suitable laminating method, as is well known in the art. The lamination may be performed, for example, under suitable pressure and at a temperature above the melting point of the conductive polymer material, whereby the material of the conductive polymer layers 20, 24 and 26 flows into and fills the first internal array of isolation apertures 48 and the second internal array of isolation apertures 52. The laminate 42 is then cooled to below the melting point of the polymer while maintaining pressure. At this point, the polymeric material in the laminated structure 42 may be cross-linked, by well-known methods, if desired for the particular application in which the device will be employed. The drill holes or vias 64 may then be formed in the laminate 42 at any time after the laminate 42 has cooled.

FIG. 6 shows the result of masking and etching the external surfaces of the first and fourth metal layers of the laminated structure 42 with the patterns of the first and fourth metal layers of FIG. 3*a* and 3*d*, respectively, to form the first and second arrays of isolation channels 46 in the first and fourth metal layers 22*a*, 28*b*, respectively. The isolation channels 46 of FIGS. 3*a* and 3*d*, which appear as parallel pairs of channels in FIG. 6, operate, in combination with the grid lines 36, 38, to form a first external array of isolated major metal areas 60, separated by isolated contact areas or "islands" 61, in the first metal layer 22*a*, and a second external array of isolated major metal areas 62, separated by isolated contact areas or "islands" 63, in the fourth metal layer 28*b*. By way of example, one of the metal islands 61 in FIG. 3*a* is hatched with dots to show the perimeter of an individual metal island 61. The isolated major metal areas 60 of first the external array are staggered so that each of the first external isolated metal areas 60 overlies a position between the first array of internal isolation apertures 48, and the isolated major metal areas 62 of the second external array are staggered so that each of the second external isolated metal areas 62 overlies a position between a second internal array of internal isolation apertures 52.

Each of the first internal isolation apertures 48 in the second metal layer 22*b* overlies a position between the second internal isolation apertures 52 in the third metal layer 28*a* and underlies a position between the first external isolated metal areas 60 on the first metal layer 22*a*. Each of the second internal isolation apertures 52 in the third metal layer 28*a* underlies a position between the first internal isolation apertures 48 in the second metal layer 22*b* and overlies a position between the second external isolated metal areas 62 on the fourth metal layer 28*b*.

The shape, size, and pattern of the external arrays of isolation channels 46 and the first and second internal isolation apertures 48, 52 will be dictated by the need to optimize the electrical isolation between the metal areas. The etched pattern of the first and second internal isolation apertures 48, 52 is chosen to minimize the reduction in strength of the metal layer after etching. It is important to minimize the risk of foil rupture or ripping during the lamination process. An alternating etch pattern (as shown in FIGS. 3*b*, 3*c*) is advantageously chosen instead of a pattern of rows to minimize the risk of rupture or tearing of inner metal foil layers during the lamination process. The amount of material etched in forming isolation apertures or in forming isolation channels for the isolated metal areas should also be kept to a minimum to obtain a maximum "active area" on the electrodes that are formed from these areas (as described below) for a given footprint. However, it is necessary to design the isolation apertures and channels so as to provide sufficient clearances so that slight misregistrations between the layers normal in the manufacturing process does not lead to electrical shorts. In the illustrated embodiment, the external isolation channels 46 are in the form of pairs of narrow parallel bands, each pair of channels having a pair of opposed arcs 65 in the vicinity of each of the vias 64 (see FIG. 7).

Figure 7:
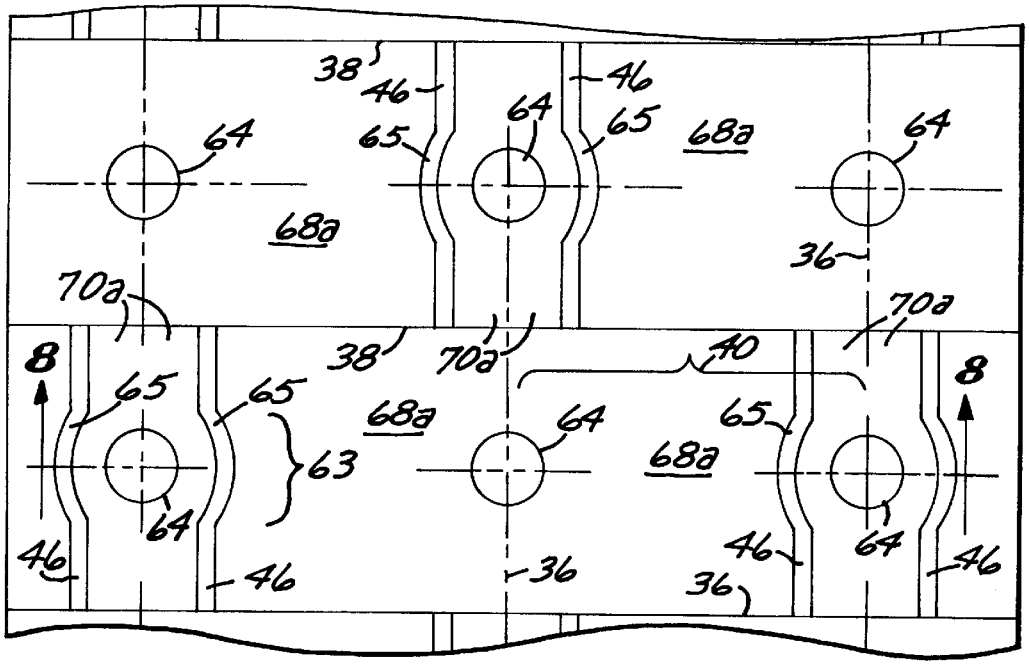
FIG. 7 is a top plan view of the structure of FIG. 6 showing the first external array of isolation channel pairs registered in a pattern of grid lines and subsequent to the formation of vias.

FIGS. 7 through 10*a* illustrate the next few steps in the fabrication process, which are performed with the laminated structure 42 oriented by means of the registration holes 18 as shown in connection with FIG. 1. As shown in FIG. 7, the grid lines 36, 38 have been formed, as by chemical etching, across at least one, and preferably both, of the external surfaces of the laminated structure 42. The first set of grid lines 36 comprises a parallel array of lines that are generally parallel to the external isolation channels 46, and are spaced at uniform intervals through the center lines of the vias 64, thereby bisecting each of the islands 61 and each of the isolated metal areas 60. The second set of grid lines 38 comprises a parallel array of lines that perpendicularly intersect the first set of grid lines 36 at regularly-spaced intervals, dividing the first external metal layer 22*a* and the fourth metal layer 28*b* into a grid of substantially rectangular device areas, with each device area defining the external surface limits of an individual conductive polymer device. Each device area defined in the first metal layer 22*a* is partitioned by a single isolation channel 46 into a first major external metal area 68*a* and a first minor area 70*a*. Each device area defined in the fourth metal layer 28*b* is partitioned by a single isolation channel 46 into a second major external metal area 68*d* and a second external minor area 70*d*. Thus, each external major area 68, 68*d* is bounded on one side by a grid line 36 separating it from an adjoining major external metal area 68, 68*d*, and on the opposite side by an isolation channel 46, while each external minor area 70*a*, 70*d* is bounded on one side by an isolation channel 46 and a grid line 36 separating it from an adjoining external minor area 70*a*, 70*d*.

Figure 8:
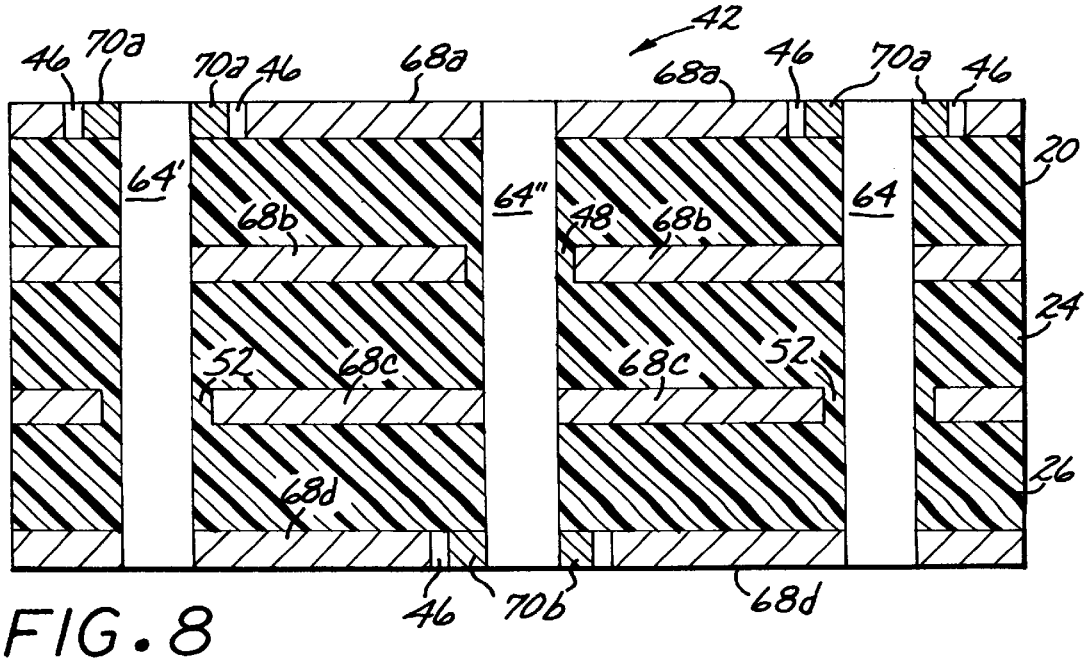
FIG. 8 is a cross-sectional view taken along line 8—8 of FIG. 7, showing vias passing through isolation apertures.

Referring to FIGS. 7 and 8, the grid lines 36, 38, in combination with the isolation channels 46 on the first and fourth external metal layers 22*a*, 28*b*, form a plurality of first and second external major areas 68*a*, 68*d* and first and second external minor areas 70*a* and 70*d* on the first and fourth metal layers 22*a*, 22*b*, respectively. Specifically, each of the islands 61, 63 is bisected by a grid line 36 into a pair of adjoining external minor metal areas 70*a*, 70*b*, respectively, while each of the external major areas 68*a*, 68*d* is likewise bisected by a grid line 36. Furthermore, each of the major metal areas 68*a*, 68*d* is separated from an adjacent external minor area 70*a*, 70*d*, by an isolation channel 46.

The grid lines 36, 38, in combination with the isolation apertures 48, 52, also define areas of the second metal layer 22*b* and the third metal layer 28*a* that form a plurality of first internal metal areas 68*b* in the second metal layer 22*b*, and a plurality of second internal metal areas 68*c* in the third metal layer 28*a*. The first external major metal areas 68*a* in the first metal layer 22*a* are in substantial vertical alignment with the second internal metal areas 68*c* in the third metal layer 28*a*, and the first internal metal areas 68*b* in the second metal layer 22*b* are in substantial vertical alignment with the second external major metal areas 68*d* in the fourth metal layer 28*b*.

The metal areas 68*a*, 68*b* 68*c*, 68*d* will serve as electrode elements in an individual device. More specifically, the first external major areas 68*a* will serve as first external electrodes, the first internal areas 68*b* will serve as first internal electrodes, the second internal electrodes, and the second external major areas 68*d* will serve as second external electrodes. Hereinafter, the metal areas 68*a*, 68*b* 68*c*, 68*d* will be referred to, respectively, as the first external electrodes 68*a*, the first internal electrodes 68*b*, the second internal electrodes 68*c*, and the second external electrodes 68*d*.

As shown in FIGS. 7 and 8, a plurality of through-holes or "vias" 64 is punched or drilled through the laminated structure 42 at regularly-spaced intervals along each of the first set of grid lines 36, preferably approximately mid-way between each adjacent pair of the second set of grid lines 38. Because the first and second internal isolation apertures 48, 52 are staggered, as described above, the electrodes 68*a*, 68*b* 68*c*, 68*d* are also staggered relative to each other, as best shown in FIG. 8. Moreover, each of the vias 64 extends through only one of the internal isolation apertures, with successive vias 64 extending alternately through a first isolation aperture 48 and a second isolation aperture 52.

Specifically, referring to FIG. 8, a first via 64' extends through the juncture of two adjoining first minor areas 70*a*, the juncture of two adjoining first internal electrodes 68*b*, a second internal isolation electrode 52, and the juncture of two adjoining second external electrodes 68*d*. A second via 64" extends through the juncture of two adjoining first external electrodes 68*a*, a first internal isolation aperture 48, the juncture of two adjoining second internal electrodes 68*c*, and the juncture of two second minor areas 70*b*.

Figure 9:
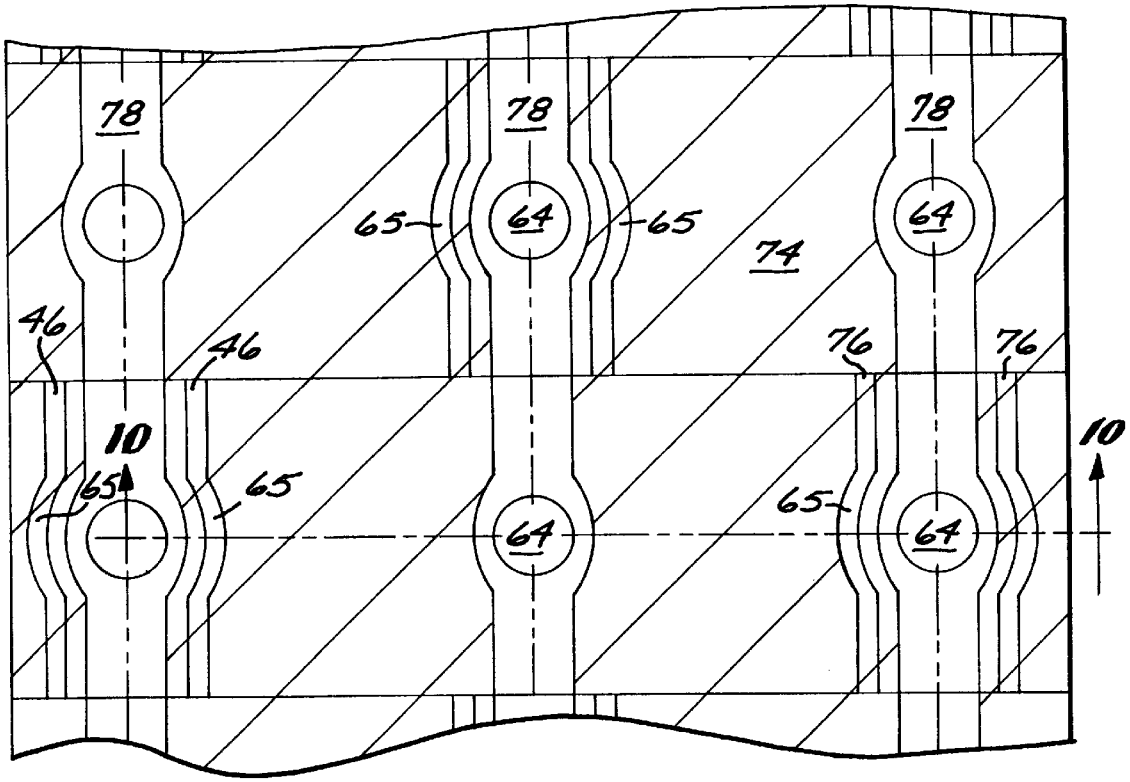
FIG. 9 is a top plan view of the laminated structure, after the performance of the step of depositing an insulative coating on the surface to form insulative isolation areas on the external metal areas.
Figure 10A:
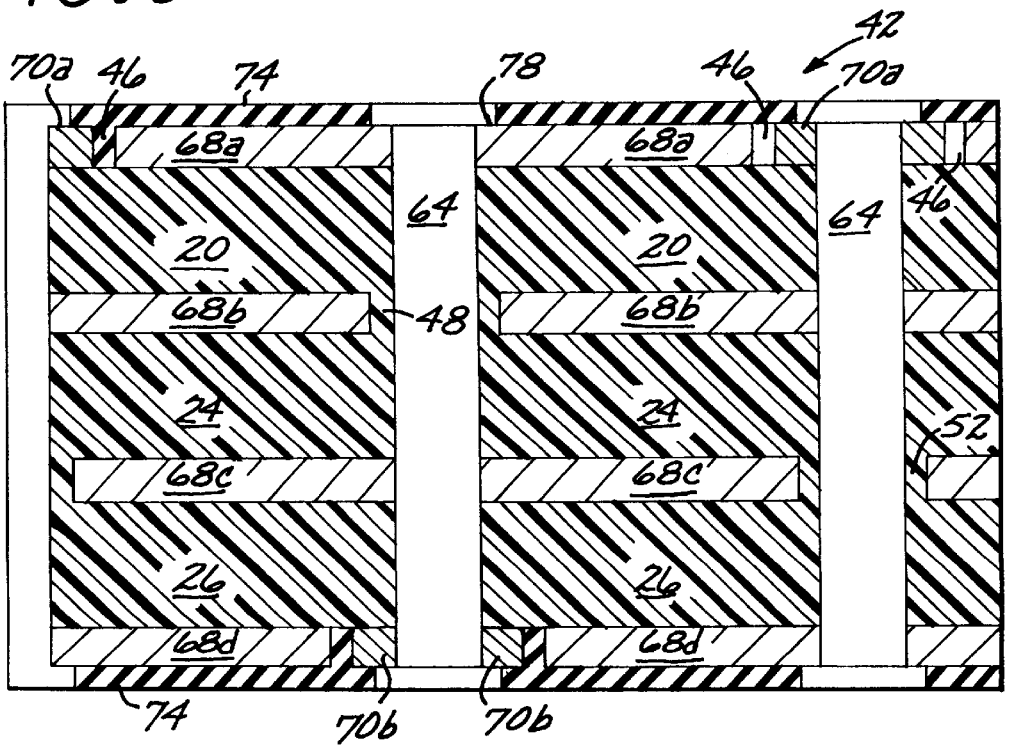
FIGS. 10*a* and 10*b* are cross-sectional views, taken along line 10—10 of FIG. 9, respectively prior to and subsequent to the step of metal-plating the vias and adjacent surface portions of the external metal areas.

FIGS. 9 and 10*a* show a thin isolating layer 74 of electrically insulating material, such as a glass-filled epoxy resin, that is formed (as by screen printing) on each of the external major surfaces of the laminated structure 42 (i.e., the top and bottom surfaces, as viewed in the drawings). The isolating layers 74 are applied so as to cover the isolation channels 46 and all but narrow peripheral edges of the first and second external electrodes 68*a*, 68*d* and narrow peripheral edges of the first and second minor metal areas 70*a*, 70*b*.

The resulting pattern of the thin isolating layers 74 leaves a series of exposed strips of metal 78 on the external surfaces of the laminated structure 42, as shown in FIG. 10*a*, with each strip 78 presenting a regular sequence of enlarged contact regions centered on the first set of grid lines 36 on the top and bottom major surfaces of the laminated structure 42. The arcs 65 in the isolation channels 46 define a "bulge" around each of the vias 64, so that each via 64 is completely surrounded by exposed metal, as best shown in FIG. 9. The isolating layers 74 are then cured by the application of heat, as is well known in the art.

The specific order of the three major fabrication steps described above in connection with FIGS. 6 through 9 may be varied, if desired. For example, the isolation layers 74 may be applied either before or after the vias 64 are formed, and the scoring step for forming the grid lines 36, 38 may be performed as the first, second or third of these steps.

Figure 10B:
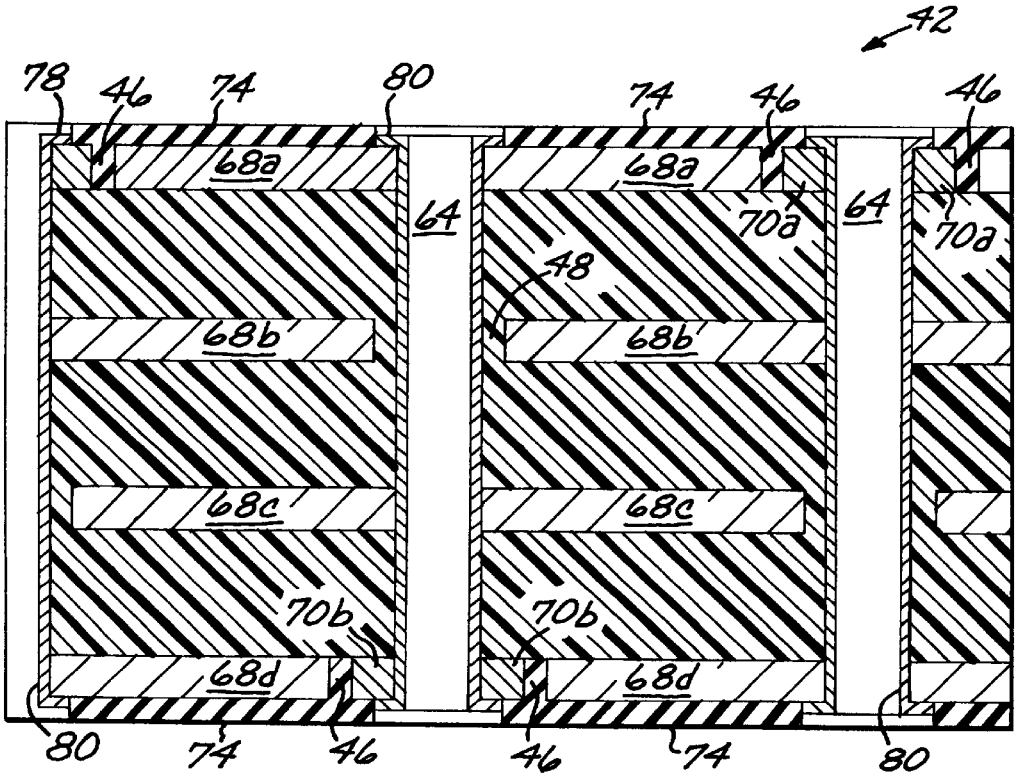
Figure 11:
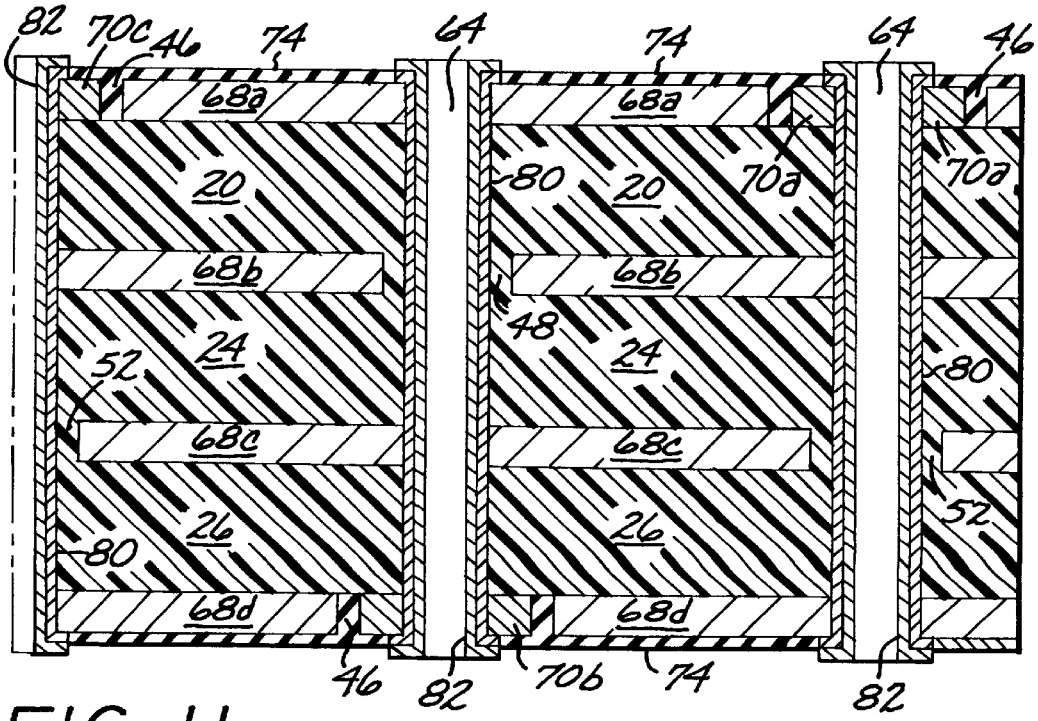
FIG. 11 is a cross-sectional view, similar to that of FIGS. 10*b*, after the step of plating the metallized surfaces with solder.

Next, as shown in FIG. 10*b*, all exposed metal surfaces (i.e. the series of exposed strips of metal 78) and the internal surfaces of the vias 64 are coated with a plating 80 of conductive metal, such as tin, nickel, or copper, with copper being preferred. This metal plating step can be performed by any suitable process, such as electrodeposition, for example. Then, as shown in FIG. 11, the areas that were metal-plated in the previous step are again plated with a thin solder coating 82. The solder coating 82 can be applied by any suitable process that is well-known in the art, such as reflow soldering or vacuum deposition.

Figure 12A:
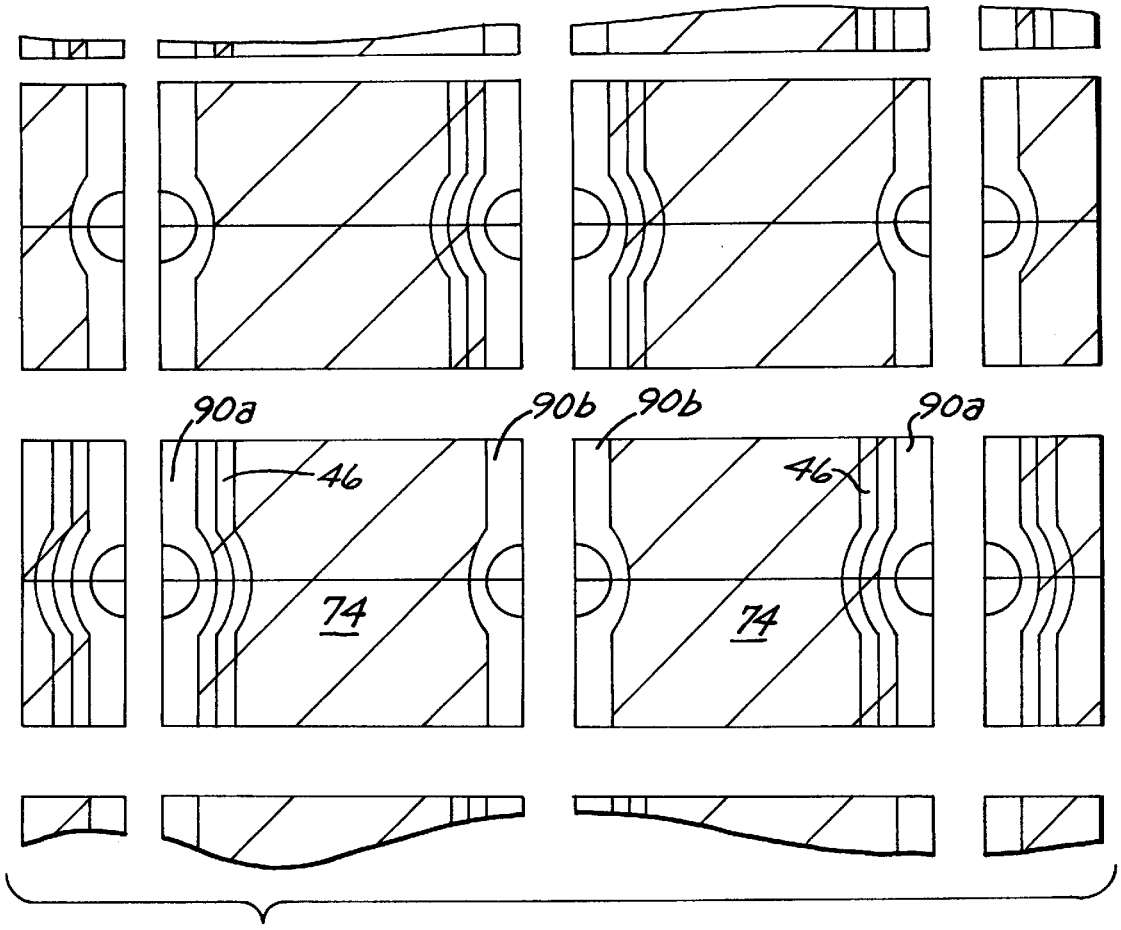
FIG. 12*a* is a top plan view of the laminated structure of FIG. 9, after the steps of FIGS. 10*a*, 10*b*, 11, showing the step of singulating by cutting the laminated structure along the previously etched score lines, on the external surfaces, to form a plurality of individual conductive polymer devices.
Figure 12B:
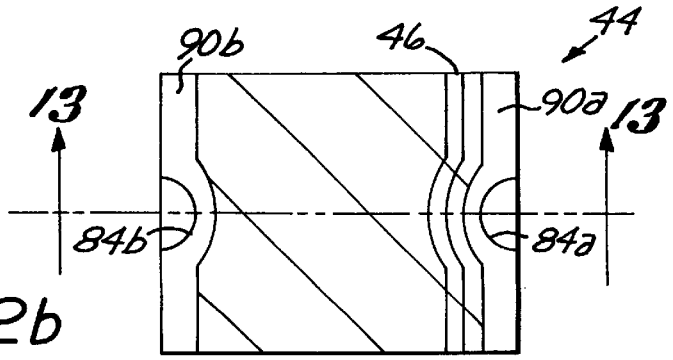
FIG. 12*b* is a top plan view of a singulated conductive polymer device selected from the devices shown in FIG. 12*a;*
Figure 13:
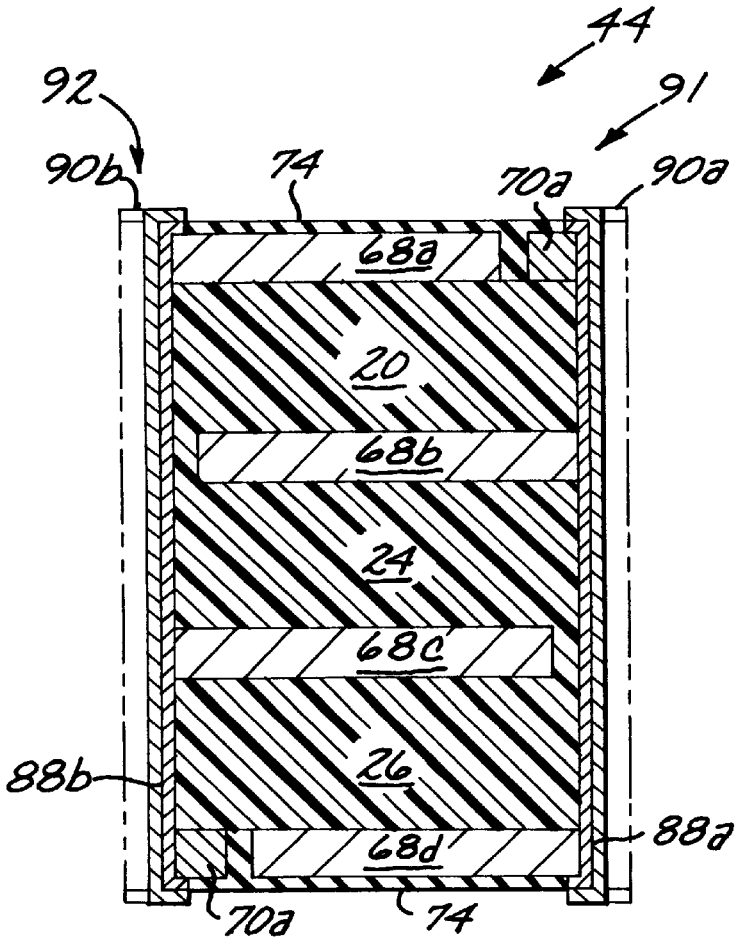
FIG. 13 is a cross-sectional view taken along line 13—13 of FIG. 12*b;*

Finally, as shown in FIGS. 12*a*, 12*b*, and 13, the laminated structure 42 is singulated (by well-known techniques) along the grid lines 36, 38 to form a plurality of individual conductive polymer devices 44, one of which is shown in FIGS. 12*b* and in the sectional view of FIG. 13 taken on section line 13—13 of FIG. 12*b*. Because each of the first set of grid lines 36 passes through a succession of vias 64 in the laminated structure 42, as shown in FIG. 7, each of the devices 44 formed after singulation has a pair of opposed sides 84a, 84b, each of which includes a haff via.

The metal plating and the solder plating of the vias 64, described above, create first and second conductive vertical columns 88*a*, 88*b* in the half vias on the opposed sides 84a, 84b, respectively. FIG. 13 shows that the first conductive column 88*a* is in intimate physical contact with the first internal electrode 68*b* and the second external electrode 68*d*. The second conductive column 88*b* is in intimate physical contact with the first external electrode 68*a* and the second internal electrode 68*c*. The first conductive column 88*a* is also in contact with the first minor metal area 70*a*, while the second conductive column 88*b* is in contact with the second minor metal area 70*b*. The minor metal areas 70*a*, 70*b* (as best shown in FIG. 8) are of such small area as to have a negligible current-carrying capacity, and thus do not function as electrodes, as will be seen below.

FIGS. 12*a*, 12*b*, and 13 also show that each device 44 includes first and second pairs of metal-plated and solder-plated conductive strips 90*a*, 90*b* along opposite edges of its top and bottom surfaces. The first and second pairs of conductive strips 90*a*, 90*b* are respectively contiguous with the first and second conductive columns 88*a*, 88*b*. The first pair of conductive strips 90*a* and the first conductive column 88*a* form a first terminal 91, and the second pair of conductive strips 90*b* and the second conductive column 88*b* form a second terminal 92. The first terminal 91 provides electrical contact with the first internal electrode 68*b* and the second external electrode 68*d*, while the second terminal 92 provides electrical contact with the first external electrode 68*a* and the second internal electrode 68*c*. The first terminal 90*a* is electrically isolated from the second internal electrode 68*c* by the polymeric material that had filled the second array of internal isolation apertures 52 during the lamination step of the process, as described above. Similarly, the second terminal 90*b* is electrically isolated from the first internal electrode 68*b* by the polymeric material that had filled the first array of isolation apertures 48 during the lamination step.

For the purposes of this description, the first terminal 91 may be considered an input terminal and the second terminal 92 may be considered an output terminal, but these assigned roles are arbitrary, and the opposite arrangement may be employed. The current paths from the input terminal 91 to the output terminal 92 of the three layer device 44 in FIG. 13 is as follows: (a) Through the first internal electrode 68*b*, the first conductive polymer PTC layer 20, and the first external electrode 68*a*; (b) through the second external electrode 68*d*, the third conductive polymer layer 26, and the second internal electrode 68*c*; and (c) through the first internal electrode 68*b*, the second (middle) conductive polymer layer 24, and the second internal electrode 68*c*. This current flow path is equivalent to connecting the three conductive polymer PTC layers 20, 24, and 26 in parallel between the input and output terminals 91, 92.

Figure 14:
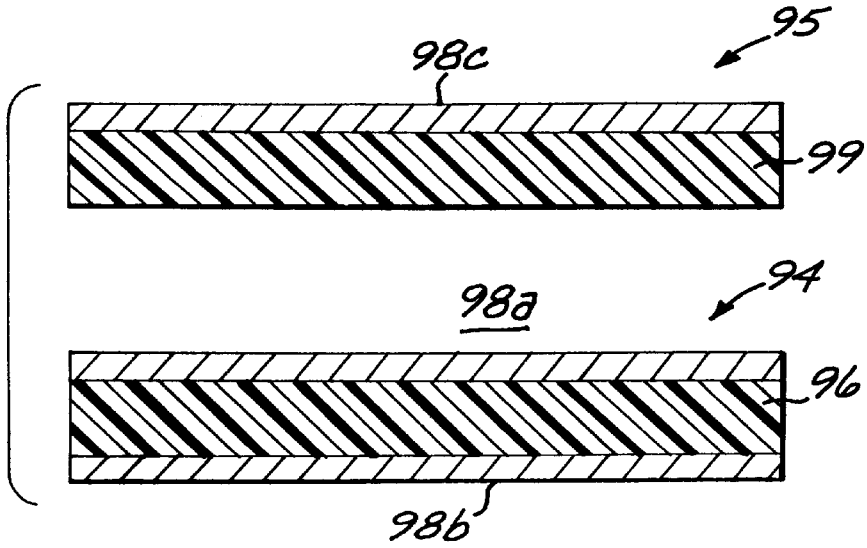
FIG. 14 is an idealized cross-sectional view of a conductive polymer layer with a metal layer on a first surface, and a laminated substructure provided as a first step in making a two-layer conductive polymer device.

The fabrication method described above for a three layer device can adapted to make two and four layer devices, or devices with more than four layers. A two layer device provides two conductive polymer layers operating in parallel. Such a device would have a higher resistance than a comparably sized three layer device but it would also be less complex and therefore, less costly to make. A four layer device would be more complex but will provide an additional reduction in resistance for a given size than a three layer device, but at a higher cost due to the added complexity. FIGS. 14–18 illustrate the steps in the method of manufacturing a two layer device. Referring first to FIG. 14, a first laminated substructure 94 is shown, along with a second laminated substructure 95 on top of the first laminated substructure 94. The first and second substructures 94, 95 are provided as the initial step in the process of fabricating a two layer conductive polymer PTC device in accordance with the present invention.

The first laminated substructure 94 comprises a first layer of conductive polymer material 96 sandwiched between first and second metal layers 98*a*, 98*b*. The second laminated substructure 95 comprises a second layer of conductive polymer material 99 with a third metal layer 98*c* laminated to its upper surface (as oriented in the drawings). The second metal layer 98*b* and the third metal layer 98*c* are the "external" metal layers, as shown in FIGS. 14–18.

The metal layers 98*a*, 98*b*, 98*c* are made of nickel foil (preferred for the internal layer 98*a*) or copper foil with a nickel flash coating. Those surfaces of the metal layers that are to come into contact with a conductive polymer layer are preferably nodularized, as described above in connection with the metal layers 22*a*, 22*b*, 28*a*, and 28*b* for the three layer device.

Figure 15:
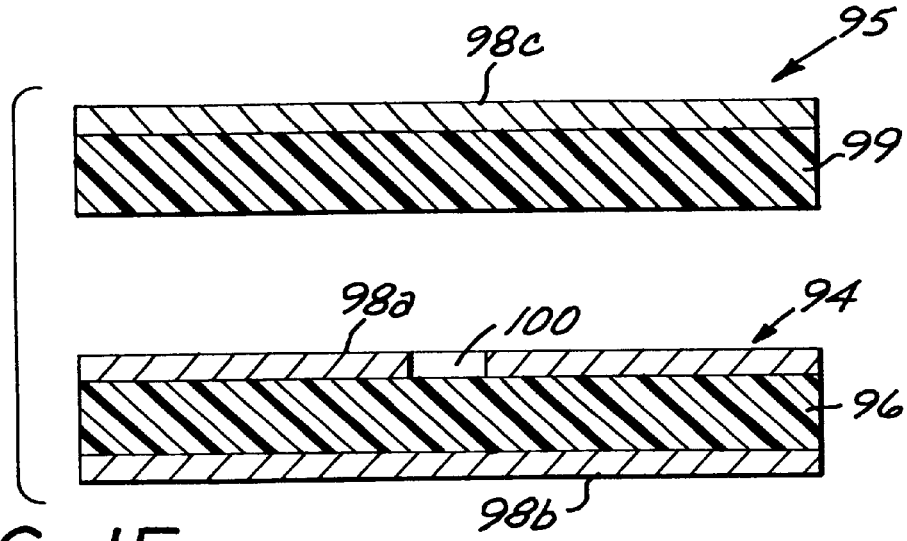
FIG. 15 is an idealized cross-sectional view, similar to that of FIG. 14, with a first array of isolation apertures having been formed in the first metal layer.

The second and subsequent steps in the method of manufacturing a two layer device are analogous to the steps illustrated in FIGS. 4–12, discussed above, for manufacturing a three layer device. FIG. 15 shows the step of forming an array of internal isolation apertures 100 in the first metal layer 98*a*. The internal isolation apertures 100 (only one of which is shown in the drawings), are registered in accordance with the grid patterns previously characterized by FIGS. 3*a*–3*d*. That is, they are registered in alternating parcels defined by the grid lines 36, 38 (FIG. 7). The metal removal from the first metal layer 98*a* to form the array of internal isolation apertures 100 is accomplished by conventional printed circuit board fabrication methods, such as those techniques employing photoresist, masks, and etching methods.

Figure 16:
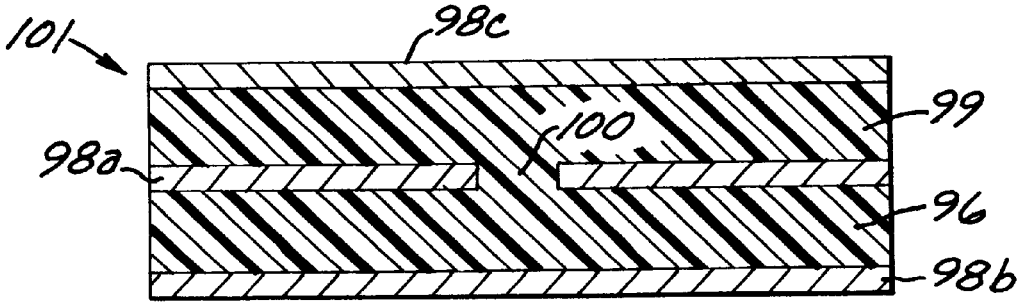
FIG. 16 is an idealized cross-sectional view of a laminated structure, after the step of laminating the components shown in FIG. 15, showing a first array of isolation apertures within the laminated structure.

FIG. 16 shows the next step of laminating the first substructure 94 to the second laminated substructure 95 so as to create a laminated structure 101, which is analogous to the laminated structure 42 described above in connection with FIG. 5. The laminated structure 101 comprises the first conductive polymer layer 96 sandwiched between the first metal layer 98*a* and second metal layer 98*b*, and the second conductive polymer layer 99 sandwiched between the first metal layer 98*a* and the third metal layer 98c.

Figure 17:
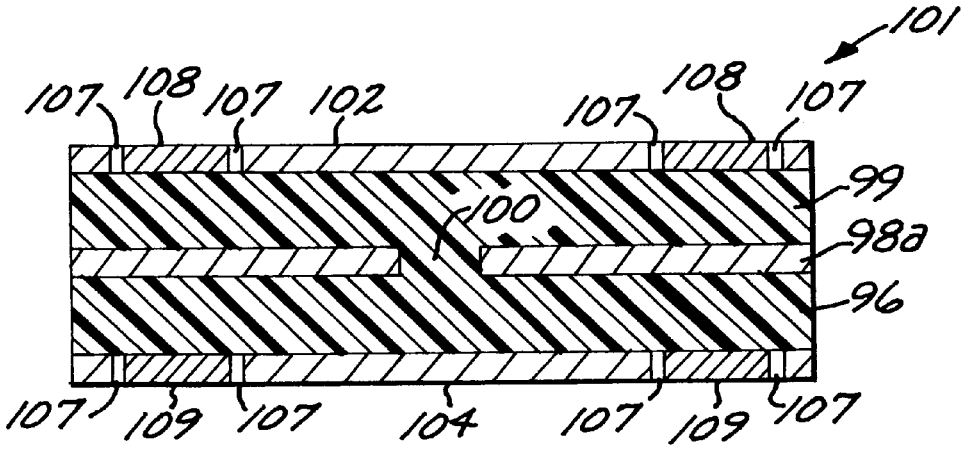
FIG. 17 is an idealized cross-sectional view, similar to that of FIG. 16, showing external arrays of isolated metal areas formed in the third and second metal layers.

FIG. 17 shows the laminated structure after the next step of forming arrays of external isolated metal areas 102, 104 in the second and third metal layers 98*b*, 98*c*, respectively. (Only one each of the areas 102, 104 is shown in the drawings.) The isolated metal areas 102 in the second metal layer 98*b* and the isolated metal areas 104 in the third metal layer 98*c* are registered in substantial vertical alignment, i.e., one above the other. The array of internal isolation apertures 100 in the first metal layer 98*a* is registered between the isolated metal areas 102, 104 in the second and third metal layers 98*b*, 98*c*. The isolated metal areas 102, 104 are formed by arrays of isolation channels 107 formed in the second and third metal layers 98*b*, 98*c*. The isolation channels 107 are analogous to the isolation channels 46 described above in connection with the three layer device 44. As in the above-described three layer device 44, and analogous to the structure described above in connection with FIG. 6, the pattern of the isolation channels 107 results in the isolated metal areas 102 of the second metal layer 98*b* being separated by isolated contact areas or "islands" 108, and the isolated metal areas 104 of the third metal layer 98*c* being separated by metal islands 109. The arrays of isolation apertures 100, the arrays of isolated metal areas 102, 104, the pattern of the isolation channels 107, and the arrays of metal islands 108, 109 are all patterned with respect to a pattern of grid lines, such as the grid lines 36, 38 described above in connection with FIGS. 3*a*–3*d*.

Figure 18:
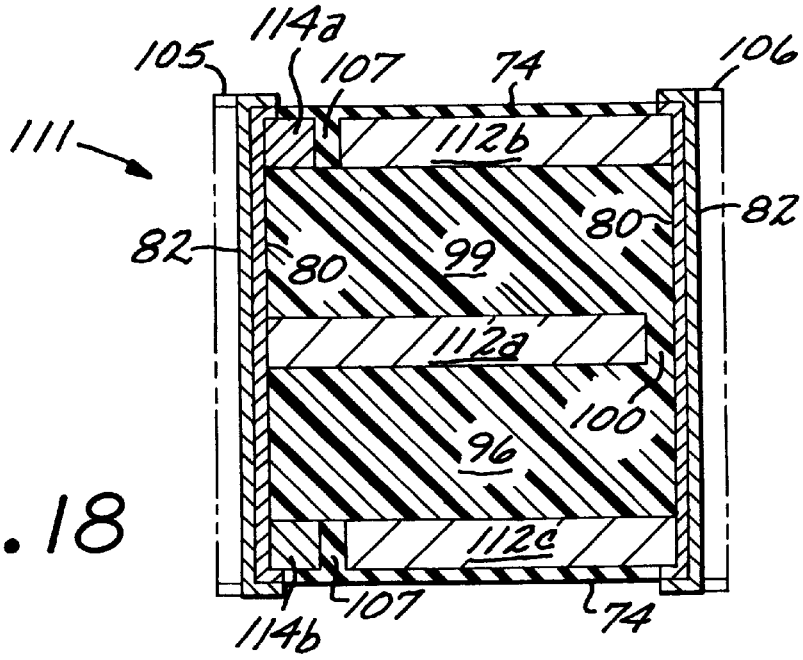
FIG. 18 is a cross-sectional view of a singulated two layer conductive polymer device in accordance with the present invention.

The laminated structure 101 is then processed in accordance with 5 the steps described above in connection with FIGS. 7–12*b*. FIG. 18 schematically shows a resulting completed two layer device 111 in section after the step of singulation described above in connection with FIGS. 12*a* and 12*b*. The two layer device 111 has a first terminal 105 and a second terminal 106, each of which comprises a conductive metal plating 80 and a solder coating 82, as described above. The first metal layer 98*a* is formed into a middle or internal electrode 112*a*, the second metal layer 98*b* is formed into a first outer electrode 112*b*, and the third metal layer 98 is formed into a second outer electrode 112*c*.

As with the case of three layer devices, the electrodes are made of a metal foil made of a material selected from the group consisting of nickel and nickel-coated copper. An insulating layer 74 is shown on the first external electrode 112*b* excluding the first terminal 105 and on the surface of the second external electrode 112*c* excluding the second terminal 106.

The first terminal 105 is in contact with first and second minor metal areas 114a, 114b that are separated from the first and second outer electrodes 112*a*, 112*b*, respectively, by the isolation channels 107. The first terminal 105 establishes electrical contact with the internal electrode 112*a*, while the second terminal 106 is in electrical contact with the first and second external electrodes 112*b*, 112*c*.

FIG. 18 thus shows a two layer electronic device 111 having a first (input) terminal 105 and a second (output) terminal 106, in which electrical current passes from the first terminal 105 to the second terminal 106 through the middle electrode 112*a*, and then through (a) the first conductive polymer layer 96 and the first external electrode 112*b*; and (b) the second conductive polymer layer 99 and the second external electrode 112*c*. Of course, the device 111 can also provide the reverse current path if the second terminal 106 is defined as the input terminal and the first terminal 105 is defined as the output terminal.

It is apparent that the fabrication method described above may be easily adapted to the manufacture of a device having any number of conductive polymer layers greater than two. FIGS. 19 through 23 illustrate specifically how the fabrication method of the present invention may be modified to manufacture a device having four conductive polymer layers. For illustrative purposes only, the first few steps in the manufacture of a four layer device will be described. FIGS. 19–23 are schematic representations only intended to draw on the above discussion of the process steps illustrated in FIGS. 1 through 13.

Figure 19:
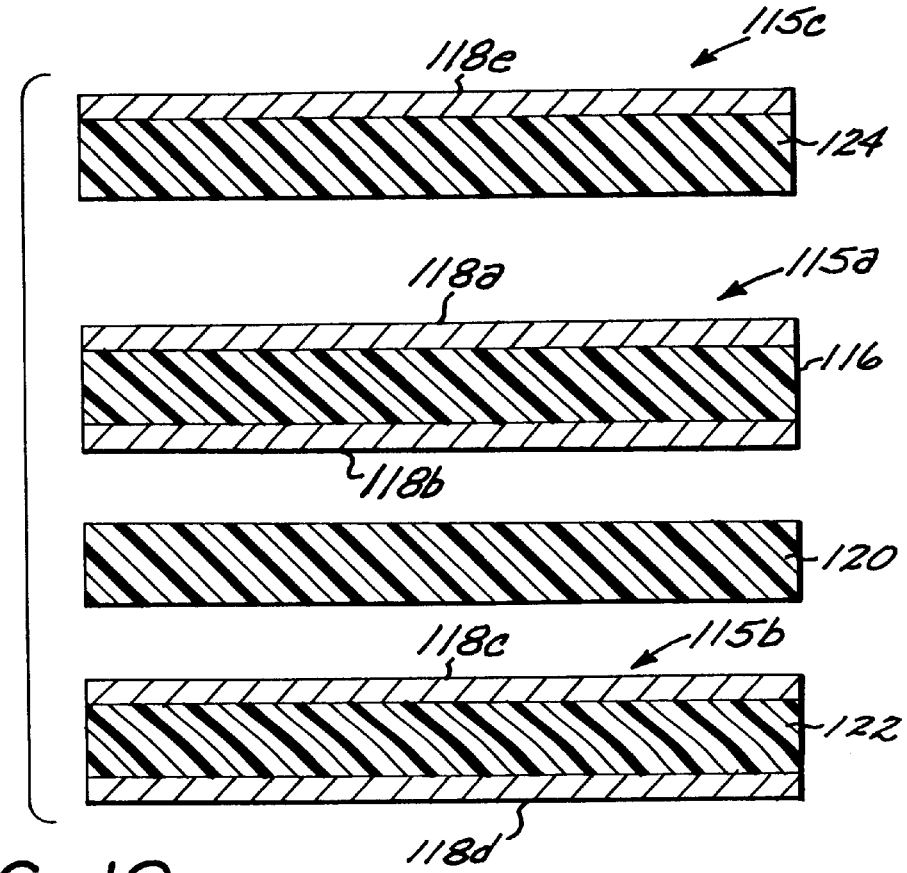
FIG. 19 is an idealized cross-sectional view of the laminated substructures and an unlaminated internal conductive polymer layer provided as a first step in making a four layer conductive polymer device in accordance with the present invention.
Figure 20:
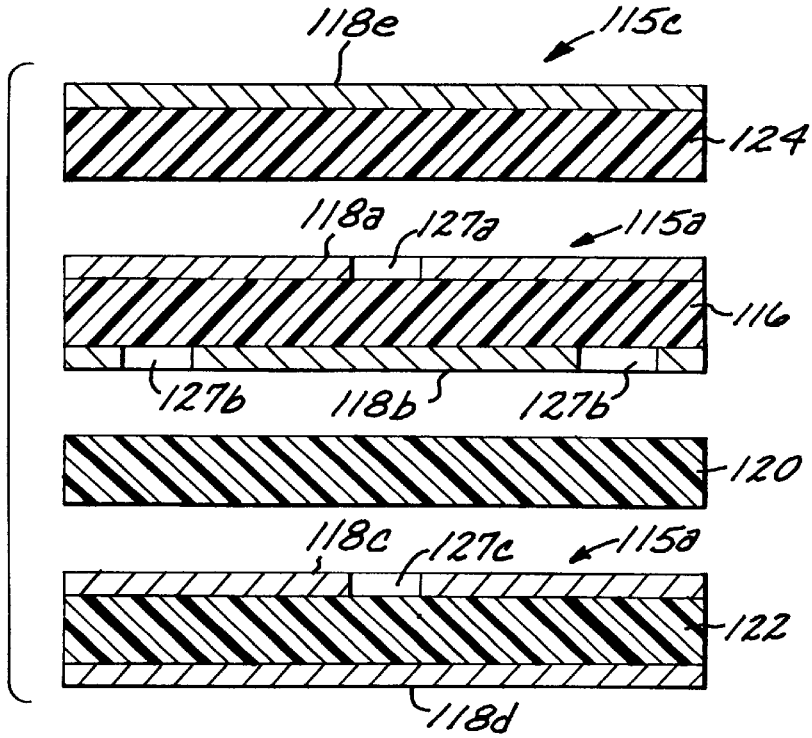
FIG. 20 is an idealized cross-sectional view, similar to that of FIG. 19, showing first, second and third internal arrays of isolation apertures formed in the first, second and third metal layers of the laminated the substructures.
Figure 21:
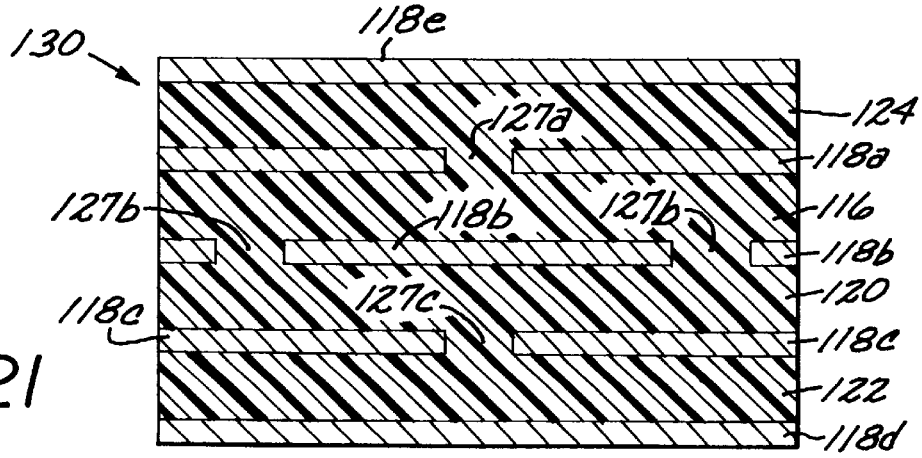
FIG. 21 is an idealized cross-sectional view showing the laminated structure formed by the lamination of the components shown in FIG. 20.

FIG. 19 illustrates a first laminated substructure 115*a*, a second laminated substructure 115*b*, and a third laminated substructure 115*c* on top of the first laminated substructure 115*a*. The first, second, and third substructures 115*a*, 115*b*, 115*c* are provided as the initial step in the process of fabricating a four layer conductive polymer device in accordance with the present invention. The first laminated substructure 115*a* comprises a first layer 116 of conductive polymer material sandwiched between first and second metal layers 118*a*, 118*b*. A second conductive polymer layer 120 is provided for placement between the first substructure 115*a* and the second substructure 115*b*. The second laminated substructure 115*b* comprises a third conductive polymer layer 122 sandwiched between third and fourth metal layers 118*c*, 118*d*. The third substructure 115*c* comprises a fourth layer 124 of conductive polymer material with a fifth metal layer 118*e* laminated to its upper surface (as oriented in the drawings). The fifth metal layer 118*e* and the fourth metal layer 118*d* are the "external" metal layers, as shown in FIGS. 19–21. The metal layers 118*a*–118*e* are made of nickel foil (preferred for the internal layers 118*a*, 118*b*, 118*c*) or copper foil with a nickel flash coating, and those surfaces of the metal layers that are to come into contact with a conductive polymer layer are preferably nodularized, as mentioned above.

The subsequent process steps are analogous to those discussed above with respect to FIG. 3*a* et seq. Specifically, FIG. 20 a shows that a first array of internal isolation apertures 127*a*, registered in accordance with a pattern of grid lines (such as the grid lines 36, 38 of FIGS. 3*b*–3*d*), is formed in the first metal layer 118*a*. A second array of internal isolation apertures 127*b*, registered in accordance with the grid lines, is formed in the second internal metal layer 118*b*. The first array of internal isolation apertures 127*a* in the first metal layer 118*a* and the second array of internal isolation apertures 127*b* in the second metal layer 118*b* are registered in alternating parcels defined by the grid lines 36, 38. A third array of internal isolation apertures 127*c* is formed in the third metal layer 118*c*. The isolation apertures 118*c* in the third array are aligned with and in registration with the apertures 127*a* in the first array. The metal removal from the first, second, and third metal layers 118*a*, 118*b*, 118*c* to form the first, second, and third arrays of isolation apertures 127*a*, 127*b*, 127*c* is accomplished by conventional printed circuit board fabrication methods, such as those techniques employing photoresist, masks and etching methods.

Referring to FIG. 21, while ensuring that the substructures 115*a*, 115*b*, 115*c*, and the second conductive polymer layer 120 are in proper registration, these substructures and the second conductive polymer layer 120 are laminated together to form a laminated structure 130. The lamination may be performed, for example, under suitable pressure and at a temperature above the melting point of the conductive polymer material, whereby the material of the conductive polymer layers 116, 120, 122, and 124 flows into and fills the isolation apertures 127*a*, 127*b*, and 127*c*. The laminate is then cooled to below the melting point of the polymer while maintaining pressure. At this point, the polymeric material in the laminated structure 130 may be cross-linked, by wellknown methods, if desired for the particular application in which the device will be employed.

Figure 22:
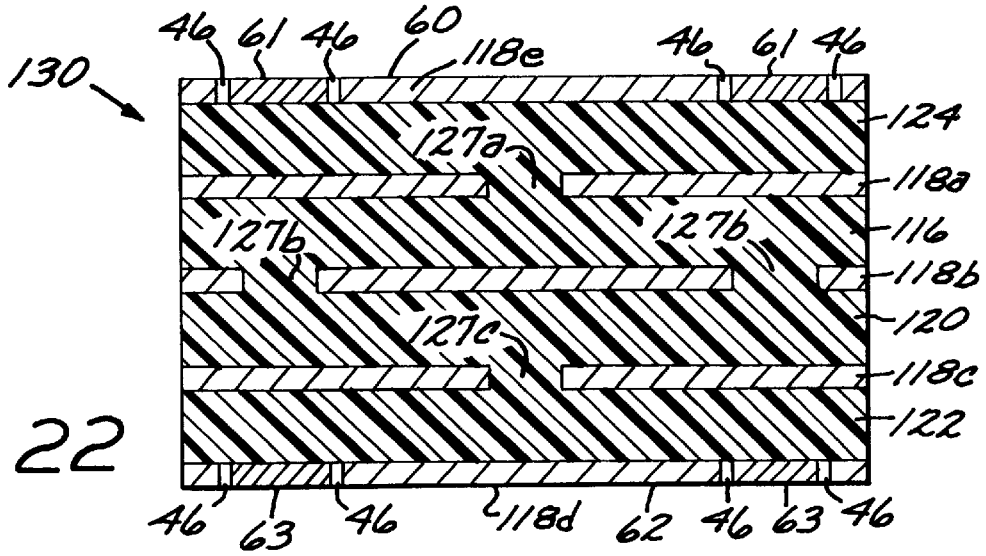
FIG. 22 is an idealized cross-sectional view, similar to that of FIG. 21, showing external arrays of isolated metal areas formed in the fourth and fifth external metal layers.

Referring now to FIG. 22, after the laminated structure 130 of FIG. 21 has been formed, arrays of external isolation channels 46 are etched into the fourth metal layer 118*d* (the first or bottom external metal layer) and the fifth metal layer 118*e* (the second or top external metal layer). As explained above, in connection with FIGS. 3*a* and 3*d* and FIGS. 6–8, the isolation channels 46 appear as parallel pairs of channels or brackets. The formation of the external isolation channels 46 in the fourth and fifth metal layers 118*d*, 118*e* creates, in combination with parceling along the grid lines 36, 38 (shown in FIGS. 3*a*, 3*d*, and 7), a first external array of isolated major metal areas 60 on the fifth metal layer 118*e* and a second external array of isolated major metal areas 62 on the fourth metal layer 118*d*. The isolation channels 46 also create a first array of metal islands 61 between each adjacent pair of major metal areas 60 in the fifth metal layer 118*e*, and a second array of metal islands between each adjacent pair of major metal areas 62 in the fourth metal layer 118*d*.

The isolated major metal areas 60 in the fifth metal layer 118*e* are staggered so that each of them overlies a position between a pair of the internal isolation apertures 127*a*. The isolated major metal areas 62 in the fourth metal layer 118*d* are staggered so that each of them underlies a position between a pair of internal isolation apertures 127*c* in the third array. Each internal isolation aperture 127*a* in the first metal layer 118*a* overlies a position between internal isolation apertures 127*b* in the second metal layer 118*b*. Each internal isolation aperture 127*b* in the second metal layer 118*b* underlies a position between first internal isolation apertures 127*a* in the first metal layer 118*a* and overlies a position between internal isolation apertures 127*c* in the third metal layer 118*c*. Each of the internal isolation apertures 127*a* in the first array also underlies a position directly below a first external isolated major metal area 60 in the fifth metal layer 118*e* and overlies a position directly above a second external isolated major metal area 62 in the fourth metal layer 118*d*. As will be seen, the arrays of external major metal areas 60, 62 provide pluralities of first and second external electrodes, and the first, second, and third (internal) metal layers provide a plurality of first, second, and third internal electrodes, respectively.

Figure 23:
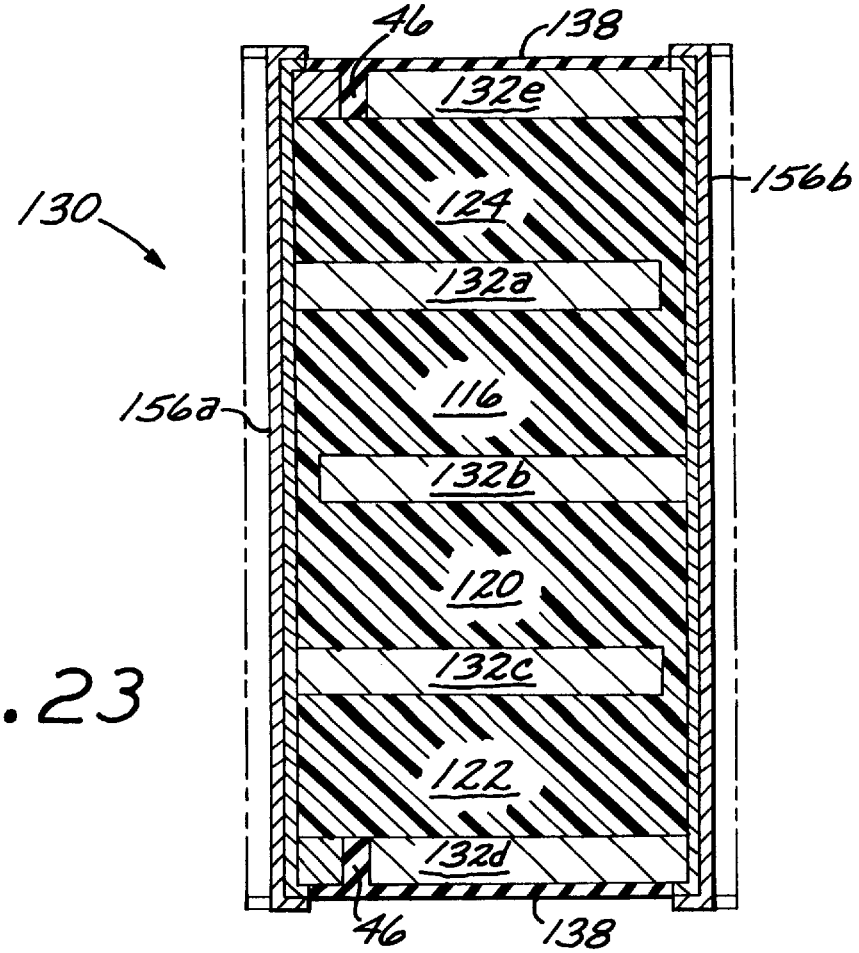
FIG. 23 is a cross-sectional view of a singulated four layer conductive polymer device, in accordance with the present invention.

Referring now to FIG. 23, the fabrication process proceeds as describe above with reference to FIGS. 8–13. After singulation, the result is a device 150 that is similar to that shown in FIGS. 12*b* and 13, except that there are four conductive polymer layers separated by three internal electrodes. The resulting device 150 is electrically equivalent to four conductive polymer elements connected in parallel between an input terminal an output terminal.

Specifically, the device 150 comprises first, second, third, and fourth conductive polymer layers 116, 120, 122, 124 respectively. The first and fourth conductive polymer layers 116, 124 are separated by a first internal electrode 132*a* that is in electrical contact with a first terminal 156*a*. The first and second conductive polymer layers 116, 120 are separated by a second internal electrode 132*b* that is in electrical contact with a second terminal 156*b*. The second and third conductive polymer layers 120, 122 are separated by a third internal electrode 132*c* that is in electrical contact with the first terminal 156*a*. A first external electrode 132*d* is in electrical contact with the second terminal 156*b* and with a surface of the third conductive polymer layer 122 that is opposed to the surface facing the second conductive polymer layer 120. A second external electrode 132*e* is in electrical contact with the second terminal 156*b* and with a surface of the fourth conductive polymer layer 124. The opposite surface of the conductive polymer layer 124 faces the first conductive polymer layer 116. Insulative isolation layers 138, similar to the insulation layers 74, described above with reference to FIG. 9 and FIG. 10, cover the portions of the external electrodes 132*d*, 132*e* between the terminals 156*a*, 156*b*. The terminals 156*a*, 156*b* are formed by the metal plating and solder plating steps described above with reference to FIGS. 10*b* and 11.

If the first terminal 156*a* is arbitrarily chosen as an input terminal, and the second terminal 156*b* is arbitrarily chosen as the output terminal, the current path through the device 150 is as follows: From the input terminal 156*a*, current enters the first and third internal electrodes 132*a*, 132*c*. From the first internal electrode 132*a*, current flows (a) through the fourth conductive polymer layer 124 and the second external electrode 132*e* to the output terminal 156*b*; and (b) through the first conductive polymer PTC layer 116 and the second internal electrode 132*b* to the output terminal 156*b*. From the third internal electrode 132*c*, current flows (a) through the second conductive polymer layer 120 and the second internal electrode 132*b* to the output terminal 156*b*; and (b) through the third conductive polymer layer 122 and the first external electrode 132*d* to the output terminal 156*b*.

It will be appreciated that the device constructed in accordance with the above described fabrication process is very compact, with a small footprint, and yet it can achieve relatively high hold currents.

While exemplary embodiments have been described in detail in this specification and in the drawings, it will be appreciated that a number of modifications and variations may suggest themselves to those skilled in the pertinent arts. For example, the fabrication process described herein may be employed with conductive polymer compositions of a wide variety of electrical characteristics, and is thus not limited to those exhibiting IPTC behavior. Furthermore, while the present invention is most advantageous in the fabrication of SMT devices, it may be readily adapted to the fabrication of multilayer conductive polymer devices having a wide variety of physical configurations and board mounting arrangements. These and other variations and modifications are considered the equivalents of the corresponding structures or process steps explicitly described herein, and thus are within the scope of the invention as defined in the claims that follow.

What is claimed is:

1. An electronic device, comprising first, second and third parallel planar electrodes;

a first conductive polymer layer between the first and second electrodes;

a second conductive polymer layer between the second and third electrodes;

a first minor metallized area coplanar with the first electrode and separated therefrom by a first isolation gap;

a second minor metallized area coplanar with the third electrode and separated therefrom by a second isolation gap;

a first terminal in physical contact with the first and second minor metallized areas, the first and second conductive polymer layers, and the second electrode; and a second terminal in physical contact with the first and third electrodes and the first and second conductive polymer layers, and isolated from the second electrode by an internal isolation area filled with conductive polymer material that joins the first and second conductive polymer layers.

2. The electronic device of claim 1, wherein each of the first and second conductive polymer layers has first and second opposed planar surfaces, and wherein the second electrode has first and second opposed surfaces, the first surface of the first conductive polymer layer being in contact with the first electrode and the first minor metallized area, the second surface of the first conductive polymer layer being in contact with the first surface of the second electrode, the first surface of the second conductive polymer layer being in contact with the second surface of the second electrode, and the second surface of the second conductive polymer layer being in contact with the third electrode and the second minor metallized area.

3. The electronic device of claim 1, wherein the first and second isolation gaps are filled with an electrically insulating epoxy resin material.

4. The electronic device of claim 1, wherein the each of the first and second terminals comprises:

a first layer formed of a metal selected from the group consisting of tin, nickel, and copper; and a second layer formed of solder.

5. An electronic device, comprising first, second, and third conductive polymer layers, each having first and second opposed planar surfaces;

a first planar electrode in contact with the first surface of the first conductive polymer layer;

a second planar electrode in contact with second surface of the first conductive polymer layer and the first surface of the second conductive polymer layer;

a third planar electrode in contact with the second surface of the second conductive polymer layer and the first surface of the third conductive polymer layer;

a fourth planar electrode in contact with the second surface of the third conductive polymer layer;

a first minor metallized area on the first surface of the first conductive polymer layer, coplanar with the first electrode and separated therefrom by a first isolation gap;

a second minor metallized area on the second surface of the third conductive polymer layer, coplanar with the fourth electrode and separated therefrom by a second isolation gap;

a first terminal in physical contact with the first minor metallized area, the second electrode, the fourth electrode, and the first, second, and third conductive polymer layers, the first terminal being isolated from the third electrode by an internal isolation area filled with conductive polymer material that joins the second and third conductive polymer layers; and a second terminal in physical contact with the second minor metallized area, the first electrode, the third electrode, and the first, second and third conductive polymer layers, the second terminal being isolated from the second electrode by an internal isolation area filled with conductive polymer material that joins the first and second conductive polymer layers.

6. The electronic device of claim 5, wherein the first and second isolation gaps are filled with an electrically insulating epoxy resin material.

7. The electronic device of claim 5, wherein the each of the first and second terminals comprises:

a first layer formed of a metal selected from the group consisting of tin, nickel, and copper; and a second layer formed of solder.

* * * * *